US010151993B2

(12) United States Patent
Kano et al.

(10) Patent No.: US 10,151,993 B2
(45) Date of Patent: Dec. 11, 2018

(54) CLEANING MEMBER, PROCESS CARTRIDGE, AND IMAGE FORMING APPARATUS

(71) Applicant: FUJI XEROX CO., LTD., Tokyo (JP)

(72) Inventors: Fuyuki Kano, Kanagawa (JP); Minoru Rokutan, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,919

(22) Filed: Sep. 8, 2017

(65) Prior Publication Data

US 2018/0210363 A1 Jul. 26, 2018

(30) Foreign Application Priority Data

Jan. 23, 2017 (JP) ..... 2017-009365

(51) Int. Cl.
*G03G 15/02* (2006.01)
*G03G 21/00* (2006.01)

(52) U.S. Cl.
CPC ..... *G03G 15/0225* (2013.01); *G03G 21/0058* (2013.01)

(58) Field of Classification Search
CPC ..... G03G 15/0225
See application file for complete search history.

(56) References Cited

U.S. PATENT DOCUMENTS 8,538,287 B2 9/2013 Kawai

FOREIGN PATENT DOCUMENTS

JP 2011191677 A * 9/2011
JP 2012-014011 A 1/2012
JP 2014153551 A * 8/2014

OTHER PUBLICATIONS

JP_2011191677_A_T Machine Translation, Japan, Yamaguchi, Sep. 2011.*
JP_2014153551_A_T Machine Translation, Japan, Kano, Aug. 2014.*

* cited by examiner

*Primary Examiner* — Victor Verbitsky
(74) *Attorney, Agent, or Firm* — Sughrue Mion, PLLC

(57) ABSTRACT

A cleaning member includes a core and an elastic layer that is helically wound around an outer peripheral surface of the core. The elastic layer is divided into three or more elastic layer sections in a width direction, and a width of the elastic layer sections at both ends in the width direction is greater than a width of the one or more elastic layer sections in a central region between the elastic layer sections at both ends in the width direction. Alternatively, the elastic layer is divided into three or more elastic layer sections in the width direction, and a minimum thickness of the elastic layer sections at both ends in the width direction is smaller than a minimum thickness of the one or more elastic layer sections in the central region between the elastic layer sections at both ends in the width direction.

20 Claims, 10 Drawing Sheets

CLEANING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-009365 filed Jan. 23, 2017.

BACKGROUND

(i) Technical Field

The present invention relates to a cleaning member, a process cartridge, and an image forming apparatus.

(ii) Related Art

An electrophotographic image forming apparatus forms an image by forming an electrostatic latent image on a surface of a photoreceptor by charging and exposure processes, forming a toner image by developing the electrostatic latent image with charged toner, and transferring and fixing the toner image to a recording medium, such as a sheet of paper. The image forming apparatus that forms an image in this way includes components that perform processes including the charging, exposure, and transferring processes, and cleaning members for cleaning the surfaces of the components.

SUMMARY

According to an aspect of the invention, there is provided a cleaning member including a core and an elastic layer that is helically wound around an outer peripheral surface of the core from one end to another end of the core. The elastic layer is divided into three or more elastic layer sections in a width direction, and a width of the elastic layer sections at both ends in the width direction is greater than a width of the one or more elastic layer sections in a central region between the elastic layer sections at both ends in the width direction. Alternatively, the elastic layer is divided into three or more elastic layer sections in the width direction, and a minimum thickness of the elastic layer sections at both ends in the width direction is smaller than a minimum thickness of the one or more elastic layer sections in the central region between the elastic layer sections at both ends in the width direction.

BRIEF DESCRIPTION OF THE DRAWINGS

Exemplary embodiments of the present invention will be described in detail based on the following figures, wherein.

DETAILED DESCRIPTION

Figure 1:
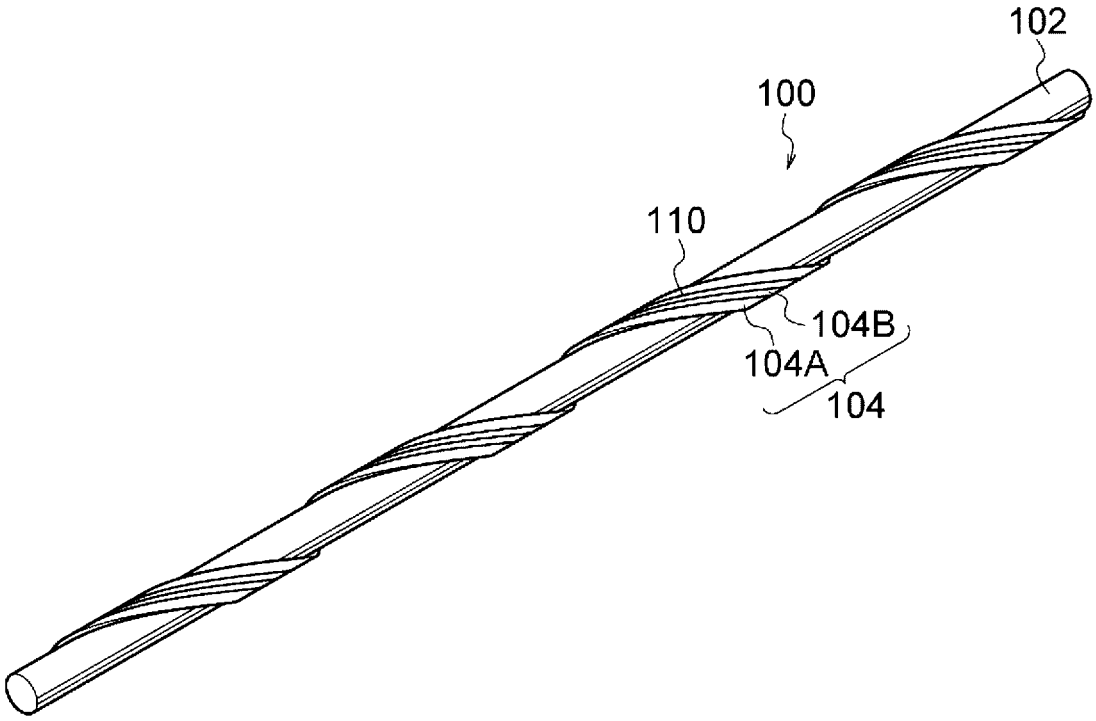
FIG. 1 is a schematic perspective view of an example of a cleaning member according to the present exemplary embodiment.

Exemplary embodiments of the present invention will now be described. Components having the same function and operation are denoted by the same reference numerals throughout the figures, and description thereof may be omitted.

In this specification, an "electrophotographic photoreceptor" may be referred to simply as a "photoreceptor".

Cleaning Member

Figure 2A:
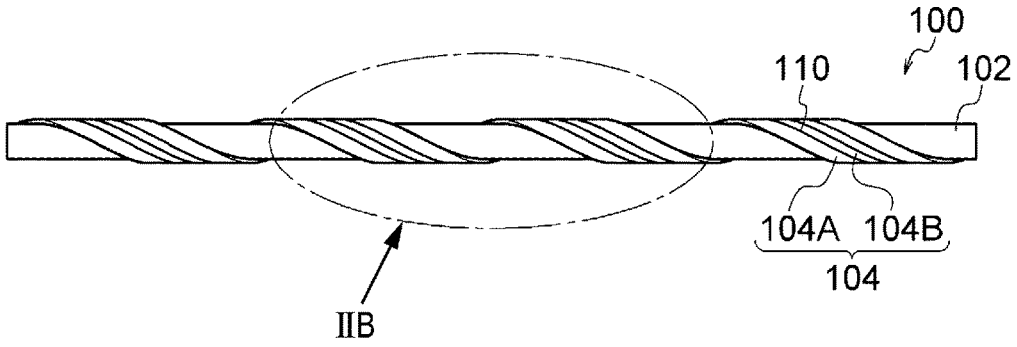
FIG. 2A is a schematic plan view of the cleaning member according to the present exemplary embodiment.
Figure 2B:
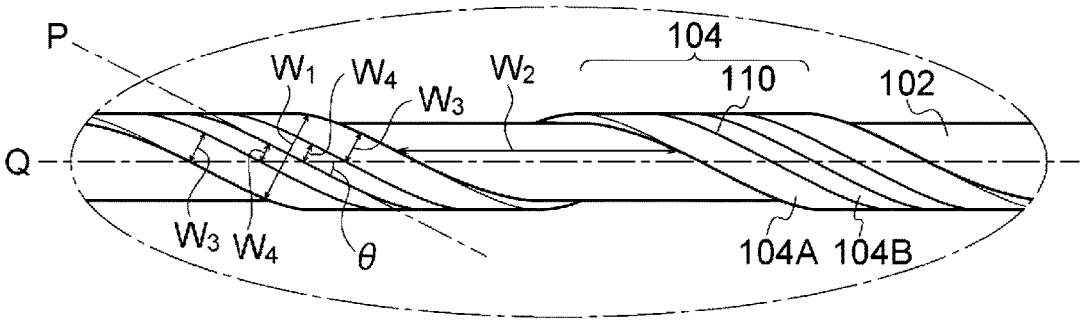
FIG. 2B is an enlarged view of part IIB in FIG. 2A.
Figure 3:
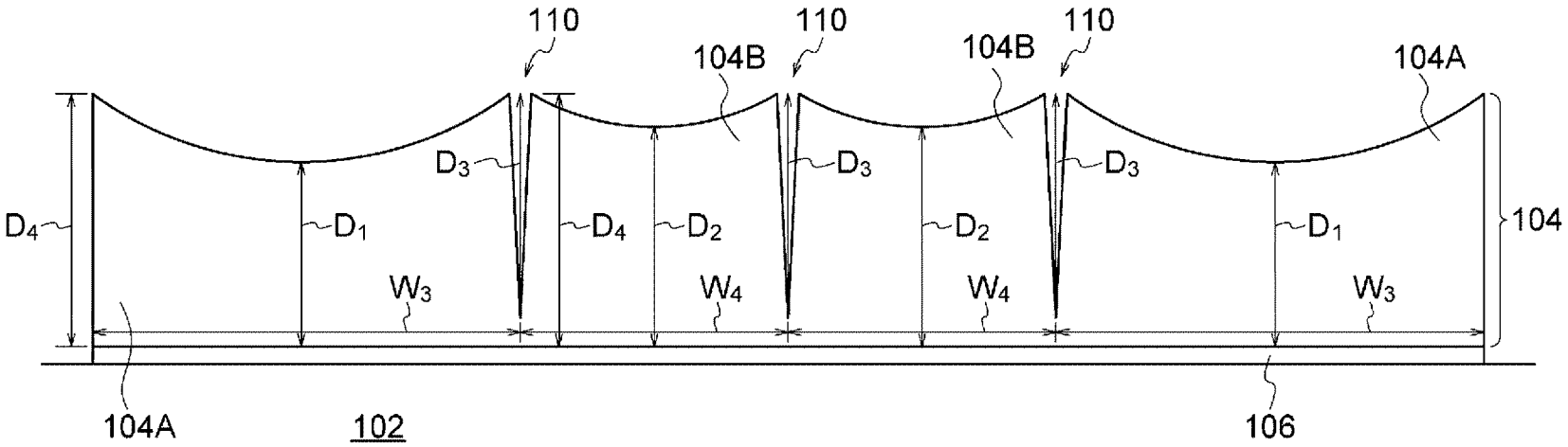
FIG. 3 is an enlarged sectional view of an elastic layer of the cleaning member according to the present exemplary embodiment.

FIG. 1 is a schematic perspective view of an example of a cleaning member according to the present exemplary embodiment. FIG. 2A is a schematic plan view of the cleaning member according to the present exemplary embodiment, and FIG. 2B is an enlarged view of part IIB in FIG. 2A. FIG. 3 is an enlarged sectional view of an elastic layer of the cleaning member according to the present exemplary embodiment. FIG. 2A is a schematic plan view of FIG. 1, and FIG. 3 is a sectional view of the elastic layer in a width direction.

Figure 4:
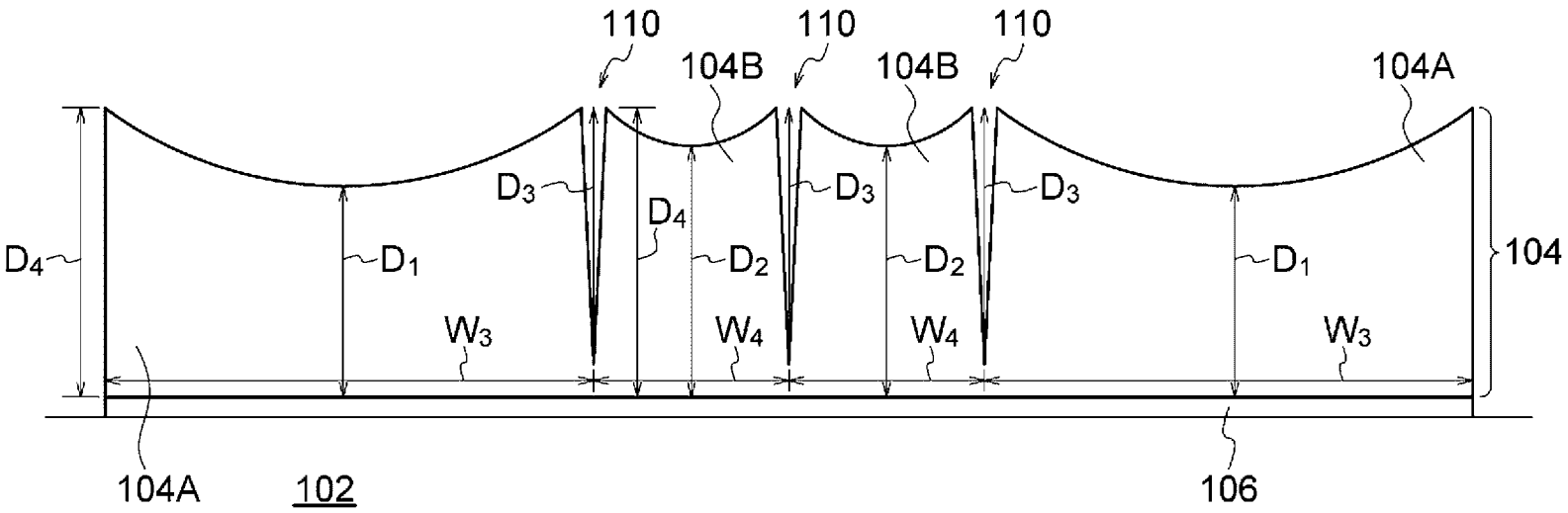
FIG. 4 is an enlarged sectional view of an elastic layer of another example of a cleaning member according to the present exemplary embodiment.
Figure 5:
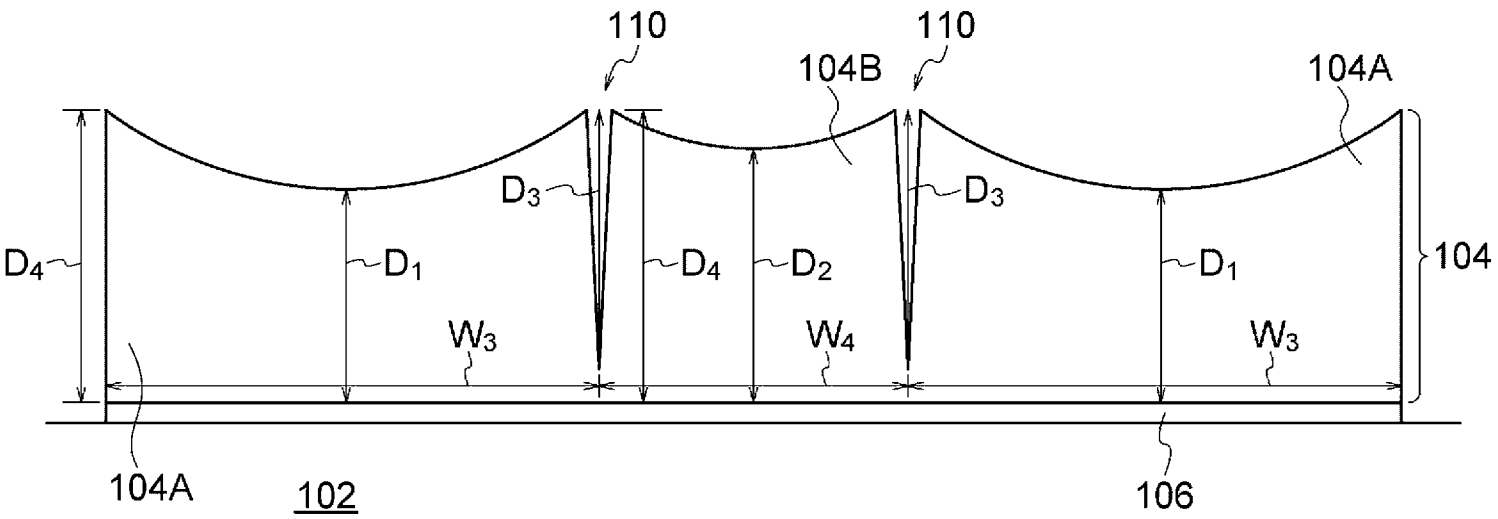
FIG. 5 is an enlarged sectional view of an elastic layer of another example of a cleaning member according to the present exemplary embodiment.

FIGS. 4 and 5 are enlarged sectional views of elastic layers of other examples of a cleaning member according to the present exemplary embodiment.

As illustrated in FIGS. 1, 2A, and 2B, according to a first exemplary embodiment and a second exemplary embodiment (in this specification, matters common to the first and second exemplary embodiments are referred to as matters according to the "present exemplary embodiment"), a cleaning member 100 is, for example, roll-shaped and includes a core 102 and an elastic layer 104. The elastic layer 104 is divided into elastic layer sections.

The elastic layer 104 of the cleaning member 100 is disposed on the outer peripheral surface of the core 102. For example, a strip-shaped elastic member is helically wound around the outer peripheral surface of the core 102 with gaps between the turns from one end to the other end of the core 102 in an axial direction of the core 102. The cleaning member 100 may have regions in which the cleaning member 100 does not need to have a function of cleaning an object to be cleaned at the ends thereof in the axial direction. In such a case, the elastic layer 104 is not necessarily provided in the above-described regions at the ends of the cleaning member 100.

As illustrated in FIGS. 3, 4, and 5, for example, the cleaning member 100 is formed by bonding the elastic layer 104 to the core 102 with an adhesive layer 106. The elastic layer 104 is formed by, for example, helically winding a strip-shaped elastic member 108 (see FIGS. 6A to 6C) around the outer peripheral surface of the core 102 from one end to the other end of the core 102 with the adhesive layer 106 provided therebetween.

As illustrated in FIGS. 3, 4, and 5, for example, the elastic layer 104 of the cleaning member 100 has two or three cuts 110. As illustrated in FIGS. 1, 2A, and 2B, the cuts 110 in the elastic layer 104 continuously extend from one end to the other end of the elastic layer 104 in the longitudinal direction thereof.

In the cleaning member 100 according to the first exemplary embodiment, as illustrated in FIGS. 3, 4, and 5, the elastic layer 104 is divided into elastic layer sections 104A and 104B, and a width $W_3$ of the elastic layer sections 104A at both ends in the width direction is greater than a width $W_4$ of the elastic layer sections 104B in a central region between the elastic layer sections 104A at both ends in the width direction.

In the cleaning member 100 according to the second exemplary embodiment, as illustrated in FIGS. 3, 4, and 5, for example, the elastic layer 104 is divided into elastic layer sections 104A and 104B, and a minimum thickness $D_1$ of the elastic layer sections 104A at both ends in the width direction is smaller than a minimum thickness $D_2$ of the elastic layer sections 104B in the central region between the elastic layer sections 104A at both ends in the width direction.

In this specification, the "width direction" of the elastic layer is a direction extending from one longitudinal side to the other longitudinal side of the elastic layer perpendicularly to the longitudinal sides in the state in which the elastic layer is wound around the core.

In this specification, the "width" of the elastic layer is the distance from one side to the other side in the width direction in the state in which the elastic layer is wound around the core.

The "width" of the elastic layer sections into which the elastic layer is divided is the distance from one side to a cut, from a cut to another cut, or from a cut to the other side in the width direction.

The "width" is measured in a deepest region to which the cuts in the elastic layer extend in the depth direction (for example, in a region in the range of ±10% from the deepest ends of the cuts). When the cuts extend to the adhesive layer, the width is measured in a region around the boundary between the elastic layer and the adhesive layer (for example, in a region in the range of ±10% from the boundary in the thickness direction of the elastic layer).

In this specification, the expression "elastic layer is divided" means that the elastic layer includes elastic layer sections that are integrated together with cuts provided therebetween.

The elastic layer sections may be in the following forms.

For example, cut pieces having predetermined widths may be prepared as elastic layer sections to be disposed at both ends and in a central region. The cut pieces may be integrated together so that longitudinal sides thereof are in contact with each other to obtain a strip-shaped elastic member. The thus-obtained elastic member may be wound around the core to form the elastic layer.

Alternatively, cuts may be formed in a strip-shaped elastic member so that the strip-shaped elastic member includes sections that have the predetermined widths and that are integrated together in such a manner that the longitudinal sides thereof are in contact with each other. The thus-obtained elastic member may be wound around the core to form the elastic layer.

Alternatively, cuts may be formed in a strip-shaped elastic member so that the strip-shaped elastic member includes sections that have the predetermined widths and that are not separated from each other. The thus-obtained elastic member may be wound around the core to form the elastic layer.

The cuts 110 may be formed so as to extend through the elastic layer 104 and at least partially through the adhesive layer 106 (for example, 50%). The cuts 110 may instead be formed so as to extend at least partially through the elastic layer 104 and not to extend into the adhesive layer 106.

The cuts 110 may be formed so as to extend at an angle (for example, at an angle in the range of ±5°) with respect to the longitudinal direction of the elastic layer 104.

The cuts 110 may be formed so as to extend at an angle (for example, at an angle in the range of ±10°) with respect to the thickness direction of the elastic layer 104.

Each cut 110 may be formed in the shape of a straight line, a curved line, a wavy line, or a zigzag line when viewed in the thickness direction of the elastic layer 104 (when viewed from the front).

In this specification, the "minimum thickness" of the elastic layer sections means the smallest thickness in cross section in the width direction in the state in which the elastic layer is wound around the core. More specifically, the "minimum thickness" is the minimum distance from the boundary between the adhesive layer 106 and the elastic layer 104 that are in contact with each other to the outer surface of the elastic layer 104 in the radially outward direction of the core 102. Accordingly, the minimum thickness $D_1$ of the elastic layer sections 104A (or the minimum thickness $D_2$ of the elastic layer sections 104B) is the minimum distance from the boundary between the adhesive layer 106 and the elastic layer 104 that are in contact with each other to the outer surfaces of the elastic layer sections 104A (or the elastic layer sections 104B) in the radially outward direction of the core 102.

More specifically, as illustrated in FIGS. 3, 4, and 5, each of the elastic layer sections (104A and 104B) into which the elastic layer 104 is divided includes projecting portions, which project in the radially outward direction of the core, at both edges thereof in cross section in the width direction. Each of the elastic layer sections (104A and 104B) into which the elastic layer 104 is divided also includes a recessed portion between the edges thereof, and has a minimum thickness at the center in the width direction. In other words, as illustrated in FIGS. 3, 4, and 5, the minimum thickness $D_1$ of the elastic layer sections 104A at both ends in the width direction and the minimum thickness $D_2$ of the elastic layer sections 104B in the central region between the elastic layer sections 104A at both ends in the width direction are the thicknesses of the elastic layer sections (104A and 104B), into which the elastic layer 104 is divided, at the centers thereof in the width direction. The projecting portions of the elastic layer sections into which the elastic layer is divided extend in the longitudinal direction.

The cleaning member including the elastic layer that is wound around the core is, for example, pressed against the object to be cleaned by applying a load to the cleaning member. Accordingly, the elastic layer at the outer periphery of the cleaning member is elastically deformed so as to form a nip section (pressure contact section) along the peripheral surface of the object to be cleaned. The elastic layer of the cleaning member is in contact with and pressed against the object to be cleaned.

The elastic layer wound around the core includes projecting portions (edges) that extend in the longitudinal direction at both edges of each elastic layer section in the width direction. When the object to be cleaned is cleaned, the projecting edge portions of the elastic layer sections rotate while being in contact with the object to be cleaned, so that the cleaning performance is increased.

When, for example, the cleaning member is stored while being in contact with and pressed against the object to be cleaned, permanent compressive strain of the elastic layer may occur since portions of the elastic layer that are in contact with the object to be cleaned continuously receives a pressure. Permanent compressive strain of the elastic layer may also occur when an image-forming operation is repeated. This is because the portion of the cleaning member that comes into contact with the object to be cleaned to clean the object frequently receives a pressure. When the permanent compressive strain of the elastic layer occurs, the cleaning performance decreases. The occurrence of the permanent compressive strain of the elastic layer tends to be particularly high when the cleaning member is stored in a high-temperature high-humidity environment (for example, an environment in which the temperature is 45° C. and humidity is 90% RH).

In the cleaning member 100 according to the present exemplary embodiment, as illustrated in FIGS. 1, 2A, and 2B, the elastic layer 104 that is helically wound around the outer peripheral surface of the core 102 is divided into three or more elastic layer sections in the width direction.

In addition, in the cleaning member 100 according to the present exemplary embodiment, as illustrated in FIGS. 1, 2A, 2B, 3, 4, and 5, the elastic layer 104, which is divided into three or more elastic layer sections, is wound around the core 102 in such a manner that the elastic layer sections are integrated together with the cuts 110 provided therebetween. As described above, each of the elastic layer sections (104A and 104B) into which the elastic layer 104 is divided includes projecting portions, which project in the radially outward direction of the core, at both edges thereof in the width direction.

In the cleaning member 100 according to the first exemplary embodiment, the elastic layer 104 is formed so that the width $W_3$ of the elastic layer sections 104A at both ends in the width direction is greater than the width $W_4$ of the elastic layer sections 104B in the central region between the elastic layer sections 104A at both ends in the width direction.

In the cleaning member 100 according to the second exemplary embodiment, the elastic layer 104 is formed so that the minimum thickness $D_1$ of the elastic layer sections 104A at both ends in the width direction is smaller than the minimum thickness $D_2$ of the elastic layer sections 104B in the central region between the elastic layer sections 104A at both ends in the width direction.

Since the elastic layer 104 has the above-described structure, a reduction in the cleaning performance of the cleaning member 100 according to the present exemplary embodiment due to permanent compressive strain may be suppressed.

In the cleaning member according to the first exemplary embodiment, as described above, the elastic layer 104 is formed so that the width $W_3$ of the elastic layer sections 104A at both ends in the width direction is greater than the width $W_4$ of the elastic layer sections 104B in the central region between the elastic layer sections 104A at both ends in the width direction. Since the width $W_3$ of the elastic layer sections 104A is greater than the width $W_4$ of the elastic layer sections 104B, when the elastic layer is wound around the core in such a manner that the elastic layer sections are integrated together with the cuts 110 provided therebetween, the elastic layer sections 104B in the central region are wound while being pressed by the elastic layer sections 104A at both ends.

As a result, as illustrated in FIGS. 3, 4, and 5, the elastic layer 104 wound in the above-described manner is divided so that the elastic layer sections 104A at both ends have large recesses at the centers thereof in the width direction, and the elastic layer sections 104B in the central region have small recesses at the centers thereof in the width direction.

In other words, the difference between an edge thickness $D_4$ and the minimum thickness $D_1$ (thickness $D_1$ at the center in the width direction) of the elastic layer sections 104A at both ends (height $\Delta D_{41}$ of the projecting portions of the elastic layer sections 104A) is greater than the difference between the edge thickness D4 and the minimum thickness $D_2$ (thickness $D_2$ at the center in the width direction) of the elastic layer sections 104B in the central region (height $\Delta D_{42}$ of the projecting portions of the elastic layer sections 104B). Since the elastic layer 104 has the above-described structure, when the elastic layer 104 is in contact with and pressed against the object to be cleaned, the elastic layer sections 104B in the central section serve to support the entirety of the elastic layer 104.

Accordingly, compressive deformation of the edge portions of the elastic layer sections 104A at both ends is suppressed. As a result, a reduction in cleaning performance due to permanent compressive strain may be suppressed.

When the width $W_3$ of the elastic layer sections 104A at both ends in the width direction is smaller than the width $W_4$ of the elastic layer sections 104B in the central region, the size of the recesses at the centers of the elastic layer sections 104B in the central region tends to increase. Therefore, the elastic layer sections 104B in the central region may not be able to appropriately support the entirety of the elastic layer 104.

In the cleaning member according to the second exemplary embodiment, similar to the cleaning member according to the first exemplary embodiment, the elastic layer, which is divided into three or more elastic layer sections, is wound around the core 102 in such a manner that the elastic layer sections are integrated together with the cuts 110 provided therebetween. In the cleaning member according to the second exemplary embodiment, the elastic layer 104 is formed so that the minimum thickness $D_2$ of the elastic layer sections 104B in the central region is greater than the minimum thickness $D_1$ of the elastic layer sections 104A at both ends in the width direction.

Since the elastic layer 104 divided into the elastic layer sections has the above-described structure, when the elastic layer 104 is in contact with and pressed against the object to be cleaned, the elastic layer sections 104B in the central section in the width direction serve to support the entirety of the elastic layer 104. Accordingly, compressive deformation of the elastic layer sections 104A at both ends in the width direction is suppressed. As a result, a reduction in cleaning performance due to permanent compressive strain may be suppressed.

In the cleaning member according to the second exemplary embodiment, to suppress a reduction in cleaning performance due to permanent compressive strain, the width $W_3$ of the elastic layer sections 104A at both ends in the width direction may be greater than the width $W_4$ of the elastic layer sections 104B in the central region between the elastic layer sections 104A at both ends in the width direction.

According to the above-described structure, a reduction in the cleaning performance of the cleaning member 100 according to the present exemplary embodiment due to permanent compressive strain may be suppressed.

In a charging device, a transfer device, a unit for an image forming apparatus, a process cartridge, and an image forming apparatus including the cleaning member 100 having the above-described structure, a reduction in performance due to insufficient cleaning of an object to be cleaned (for example, a charging member or a transfer member) is suppressed.

Each of the components will now be described.

First, the core 102 will be described.

The material of the core 102 may be, for example, a metal or alloy. Alternatively, the material may be a resin.

Examples of the metal or alloy include metals such as iron (for example, free-cutting steel), copper, brass, aluminum, and nickel, and alloys such as stainless steel.

Examples of the resin include polyacetal resins; polycarbonate resins; acrylonitrile-butadiene-styrene copolymers; polypropylene resins; polyester resins; polyolefin resins; polyphenylene ether resins; polyphenylene sulfide resins; polysulfone resins; polyether sulfone resins; polyarylene resins; polyetherimide resins; polyvinyl acetal resins; polyketone resins; polyether ketone resins; polyether ether ketone resins; polyaryl ketone resins; polyether nitrile resins; liquid crystal resins; polybenzimidazole resins; polyparabanic acid resins; vinyl polymers or copolymers obtained by polymerizing or copolymerizing one or more vinyl monomers selected from the group including aromatic alkenyl compounds, methacrylic acid esters, acrylic acid esters, and vinyl cyanide compounds; diene-aromatic alkenyl compound copolymers; vinyl cyanide-diene-aromatic alkenyl compound copolymers; aromatic alkenyl compound-diene-vinyl cyanide-N-phenylmaleimide copolymers; vinyl cyanide-(ethylene-diene-propylene (EPDM))-aromatic alkenyl compound copolymers; polyolefin resins; vinyl chloride resins; and chlorinated vinyl chloride resins. These resins may be used individually or in combination with each other.

The material, surface treatment method, etc., may be selected as necessary. In particular, when the core 102 is made of a metal, the core 102 may be plated. When the core 102 is made of a non-conductive material, such as a resin, the core 102 may or may not be subjected to a common conductivity imparting process, such as plating.

Next, the elastic layer 104 will be described.

The elastic layer 104 is a layer made of a material that returns to its original shape even when the material receives an external pressure of 100 Pa and is deformed. The elastic layer 104 may either be a foam elastic layer or a non-foam elastic layer. From the viewpoint of cleaning performance, the elastic layer 104 may be a foam elastic layer. The foam elastic layer is a layer made of a material having gas bubbles (foam material).

Examples of the material of the elastic layer 104 include foam resins such as polyurethanes, polyethylenes, polyamides, and polypropylenes, and rubber materials such as silicone rubbers, fluorine rubbers, urethane rubbers, ethylene propylene diene monomer (EPDM) rubbers, acrylonitrile-butadiene rubbers (NBR), chloroprene rubbers (CR), chlorinated polyisoprene, isoprene, styrene-butadiene rubbers, hydrogenated polybutadiene, and butyl rubbers. The material of the elastic layer 104 may be any of these materials or a mixture of two or more of these materials.

Assistant agents, such as a foaming assistant agent, a foam stabilizer, a catalyst, a curing agent, a plasticizer, and a vulcanization accelerator, may be added to the above-described materials.

The elastic layer 104 may be made of a foam polyurethane, which has a high tensile strength, to avoid damage to the surface of the object to be cleaned when the elastic layer 104 is slid therealong and to reduce the risk of tearing and breakage over a long time.

Examples of the foam polyurethane include reactants of polyols (for example, polyester polyols, polyether polyols, and acrylic polyols) and isocyanates (for example, 2,4-tolylene diisocyanate, 2,6-tolylene diisocyanate, 4,4-diphenylmethane diisocyanate, tolidine diisocyanate, and 1,6-hexamethylene diisocyanate). The reactants may be further reacted with a chain extender (1,4-butanediol, trimethylol propane).

Polyurethanes are typically foamed by using a foaming agent, such as water or an azo compound (for example, azodicarbonamide or azobisisobutyronitrile).

Assistant agents, such as a foaming assistant agent, a foam stabilizer, and a catalyst, may be added to the foam polyurethane.

Among the examples of the foam polyurethane, ether-based foam polyurethanes may be used because ester-based foam polyurethanes are susceptible to hydrothermal aging. Although silicone oil is typically used as a foam stabilizer for ether-based polyurethanes, there is a risk that image defects will occur due to transferring of the silicone oil to the object to be cleaned (for example, a charging roller) during storage (in particular, storage in a high-temperature high-humidity environment). Therefore, a foam stabilizer other than silicone oil may be used. In such a case, transferring of the foam stabilizer to the object to be cleaned is suppressed, and image defects due to transferring of the foam stabilizer may be reduced.

Examples of the foam stabilizer other than silicone oil include organic surface active agents that do not contain Si (for example, anion-based surface active agents such as dodecylbenzene sulfonic acid and sodium lauryl sulfate). A production method in which no silicone-based foam stabilizer is used may also be used.

Whether or not an ester-based foam polyurethane is produced by using a foam stabilizer other than silicone oil may be determined based on whether "Si" is contained by performing component analysis.

The overall width $W_1$ of the elastic layer 104 may be 11 mm or more, and more preferably, 14 mm or more. The width of the elastic layer 104 in the longitudinal direction of the core 102 in the state in which the elastic layer 104 is helically wound around the core 102 (hereinafter referred to also as a "helical width") may be more than 11 mm, and more preferably, more than 14 mm. The overall width $W_1$ and the helical width of the elastic layer 104 have upper limits that depend on the helical angle θ, but are not particularly limited as long as the elastic layer is helically woundable around the core without overlapping itself.

The elastic layer 104 is obtained by, for example, helically winding a strip-shaped elastic member 108 (strip 108) around the core 102 at a helical angle θ in the range of from 2° to 75°, more preferably, from 4° to 75°, and still more preferably, from 8° to 45° with respect to the axial direction of the core 102. In other words, the elastic layer 104 may be helically wound around the outer peripheral surface of the core 102 at an angle in the range of from 2° to 75° with respect to an axial direction Q of the cleaning member 100 (axial direction of the core).

Referring to FIG. 2B, the helical angle θ is an angle (acute angle) between a longitudinal direction P of the elastic layer 104 (helical direction) and the axial direction Q of the cleaning member (axial direction of the core).

In the cleaning member 100 according to the present exemplary embodiment, the elastic layer 104 is divided into three or more sections. To suppress a reduction in cleaning performance due to permanent compressive strain of the elastic layer 104, the elastic layer 104 may be divided into three sections or four or more sections. There is no particular upper limit to the number of sections into which the elastic layer 104 is divided. The number of sections into which the elastic layer 104 is divided may be determined based on the overall width $W_1$ of the elastic layer 104 in consideration of the effect of reducing the permanent compressive strain of the elastic layer 104. For example, the upper limit of the number of sections into which the elastic layer 104 is divided may be seven or less.

In the cleaning member according to the present exemplary embodiment, to suppress a reduction in cleaning performance due to permanent compressive strain of the elastic layer 104, the width $W_3$ of the elastic layer sections 104A at both ends in the width direction may be in the range of from 3 mm to 6 mm, or from about 3 mm to about 6 mm (more preferably, 4 mm to 5 mm).

Similarly, to suppress a reduction in cleaning performance due to permanent compressive strain of the elastic layer 104, the width $W_4$ of the elastic layer sections 104B in the central region may be in the range of from 2 mm to 5 mm or from about 2 mm to about 5 mm (more preferably, from 3 mm to 4 mm).

In the cleaning member according to the first exemplary embodiment, the width $W_3$ of the elastic layer sections 104A at both ends in the width direction is greater than the width $W_4$ of the elastic layer sections 104B in the central region. To suppress a reduction in cleaning performance due to permanent compressive strain of the elastic layer 104, the ratio of the width $W_3$ to the width $W_4$ ($W_3/W_4$) may be 1.2 or more or about 1.2 or more (more preferably, 1.5 or more, and still more preferably, 2.0 or more). There is no particular upper limit to the ratio of the width $W_3$ to the width $W_4$ ($W_3/W_4$). The ratio may be set so that the elastic layer sections 104B in the central region may be formed in such a manner that the width $W_3$ of the elastic layer sections 104A at both ends is greater than the width $W_4$ of the elastic layer sections 104B in the central region. For example, the upper limit of the ratio of the width $W_3$ to the width $W_4$ ($W_3/W_4$) may be 3.0 or less or about 3.0 or less.

The cleaning member according to the second exemplary embodiment may have a similar structure.

In the cleaning member according to the first exemplary embodiment, when the elastic layer 104 is divided into four or more sections, as illustrated in FIG. 3, the width $W_3$ of each of the elastic layer sections 104A at both ends in the width direction may be smaller than the sum of the widths $W_4$ of the elastic layer sections 104B in the central region between the elastic layer sections 104A at both ends in the width direction. Alternatively, as illustrated in FIG. 4, the width $W_3$ of each of the elastic layer sections 104A at both ends in the width direction may be greater than the sum of the widths $W_4$ of the elastic layer sections 104B in the central region between the elastic layer sections 104A at both ends in the width direction. As illustrated in FIGS. 3 and 4, the width $W_3$ of each of the elastic layer sections 104A at both ends in the width direction is greater than the width $W_4$ of each of the elastic layer sections 104B in the central region.

To suppress a reduction in cleaning performance due to permanent compressive strain of the elastic layer 104, the width $W_3$ of each of the elastic layer sections 104A at both ends in the width direction may be smaller than the sum of the widths $W_4$ of the elastic layer sections 104B in the central region between the elastic layer sections 104A at both ends in the width direction. When the elastic layer has such a structure, the elastic layer sections 104B in the central region more easily serve to support the entirety of the elastic layer 104 when the elastic layer 104 is in contact with the object to be cleaned. There is no particular upper limit to the sum of the widths $W_4$ of the elastic layer sections 104B in the central region between the elastic layer sections 104A at both ends in the width direction as long as the sum is greater than the width $W_3$ of each of the elastic layer sections 104A at both ends in the width direction. The sum of the widths $W_4$ may be determined based on the overall width $W_1$ of the elastic layer 104 and the width of a region in which the elastic layer sections 104B in the central region between the elastic layer sections 104A at both ends in the width direction may be divided from each other. The cleaning member according to the second exemplary embodiment may also have a similar structure.

To suppress a reduction in cleaning performance due to permanent compressive strain of the elastic layer 104, the ratio of the width $W_3$ of each of the elastic layer sections 104A at both ends in the width direction to the sum of the widths $W_4$ of the elastic layer sections 104B in the central region ($W_3$/sum of $W_4$) may be 0.3 or more or about 0.3 or more (more preferably, 0.5 or more, and still more preferably, 0.8 or more).

In the cleaning member according to the present exemplary embodiment, to suppress a reduction in cleaning performance due to permanent compressive strain of the elastic layer 104, the minimum thickness $D_1$ (thickness $D_1$ at the center in the width direction) of the elastic layer sections 104A at both ends in the width direction may be in the range of from 1.5 mm to 3.0 mm or from about 1.5 mm to about 3.0 mm, more preferably, from 2.0 mm to 2.5 mm.

In addition, to suppress a reduction in cleaning performance due to permanent compressive strain of the elastic layer 104, the minimum thickness $D_2$ (thickness $D_2$ at the center in the width direction) of the elastic layer sections 104B in the central region between the elastic layer sections 104A at both ends in the width direction may be in the range of from 1.7 mm to 3.2 mm or from about 1.7 mm to about 3.2 mm, more preferably, from 2.2 mm to 2.7 mm.

In the cleaning member according to the second exemplary embodiment, the minimum thickness $D_1$ of the elastic layer sections 104A at both ends in the width direction is smaller than the minimum thickness $D_2$ of the elastic layer sections 104B in the central region between the elastic layer sections 104A at both ends in the width direction. To suppress a reduction in cleaning performance due to permanent compressive strain of the elastic layer 104, the ratio ($D_1/D_2$) of the minimum thickness $D_1$ of the elastic layer sections 104A at both ends in the width direction to the minimum thickness $D_2$ of the elastic layer sections 104B in the central region between the elastic layer sections at both ends may be in the range of from 0.85 to 0.98 or from about 0.85 to about 0.98 (more preferably, from 0.90 to 0.95). The cleaning member according to the first exemplary embodiment may also have a similar structure.

In addition, in the cleaning member according to the present exemplary embodiment, to suppress a reduction in cleaning performance due to permanent compressive strain of the elastic layer 104, the difference $\Delta D_{41}$ between the edge thickness $D_4$ and the minimum thickness $D_1$ of the elastic layer sections 104A at both ends in the width direction (height of the projecting portions) may be in the range of from 0.1 mm to 0.3 mm or from about 0.1 mm to about 0.3 mm (more preferably, from 0.2 mm to 0.3 mm).

Also, the difference $\Delta D_{42}$ between the edge thickness $D_4$ and the minimum thickness $D_2$ of the elastic layer sections 104B in the central region between the elastic layer sections 104A at both ends in the width direction (height of the projecting portions) may be in the range of from 0.05 mm to 0.25 mm or from about 0.05 mm to about 0.25 mm (more preferably, from 0.05 mm to 0.15 mm). In addition, $\Delta D_{41}$ (height of the projecting portions of the elastic layer sections 104A) is greater than $\Delta D_{42}$ (height of the projecting portions of the elastic layer sections 104B in the central region).

The edge thickness $D_4$ of the elastic layer sections is a maximum distance from the boundary between the adhesive layer 106 and the elastic layer 104 that are in contact with each other to the ends of the projecting edge portions in the radially outward direction of the core 102.

The minimum thickness $D_1$ of the elastic layer sections 104A at both ends in the width direction, the minimum thickness $D_2$ of the elastic layer sections 104B in the central region, and the edge thickness $D_4$ of the elastic layer sections may be measured, for example, as described below. The width $W_3$ of the elastic layer sections 104A at both ends in the width direction and the width $W_4$ of the elastic layer sections 104B in the central region may also be measured in a similar manner.

A laser measurement device (Laser Scan Micrometer, Model LSM6200, produced by Mitutoyo Corporation) is used to measure the thickness profile of the elastic layer (elastic layer thickness profile) by scanning the cleaning member, which serves as a measurement object, in the longitudinal direction (axial direction) of the cleaning member at a traverse speed of 1 mm/s at a constant position in the circumferential direction. The measurement is performed at different positions in the circumferential direction (three positions separated from each other by 120° in the circumferential direction). The thicknesses $D_1$, $D_2$, and $D_4$ of the elastic layer 104 are calculated based on the measured profiles. The widths $W_3$ and $W_4$ are similarly determined.

The number of turns of the elastic layer 104 wound around the core 102 may be 1 or more, more preferably, 1.3 or more, and still more preferably, 2 or more. There is no particular upper limit to the number of turns of the elastic layer 104 since the number of turns depends on the length of the core 102.

To suppress a reduction in cleaning performance due to permanent compressive strain of the elastic layer 104, the depth $D_3$ of the cuts 110 in the elastic layer 104 may be large relative to the thickness of the elastic layer 104. For example, the depth $D_3$ may be 50% or more (more preferably, 70% or more, and still more preferably, 90% or more) of the thickness $D_4$ of both edge portions of the elastic layer 104. There is no particular upper limit to the depth $D_3$ of the cuts 110, and the depth $D_3$ may be, for example, 100% of the thickness $D_4$ of both edge portions of the elastic layer 104. The depth $D_3$ of the cuts 110 may be such that the cuts 110 at least partially extend into the adhesive layer 106. For example, the depth $D_3$ of the cuts 110 may be such that the cuts 110 extend into the adhesive layer 106 by 10% or more of the thickness of the adhesive layer 106, 50% or more of the thickness of the adhesive layer 106, or 100% of the thickness of the adhesive layer 106.

The coverage of the elastic layer 104 ((helical width of the elastic layer 104)/(helical width of the elastic layer 104+ helical gap $W_2$ of the elastic layer 104)) may be in the range of from 5% to 90%, more preferably, from 8% to 80%, and still more preferably, from 10% to 70%.

As illustrated in FIG. 2B, the helical gap $W_2$ is the distance between adjacent portions of the elastic layer 104 in the axial direction Q of the cleaning member 100 (axial direction of the core).

Among the three or more elastic layer sections into which the elastic layer 104 is divided, the elastic layer sections 104A at both ends in the width direction and the one or more elastic layer sections 104B in the central region between the elastic layer sections 104A at both ends in the width direction may be made of the same material or different materials. Even when the elastic layer sections are made of the same material, they may have different properties (for example, hardnesses, foaming magnifications, or compressive resiliences). For example, among the three or more elastic layer sections into which the elastic layer 104 is divided, the one or more elastic layer sections 104B in the central region may be made of a material that is less likely to cause a permanent compressive strain than the material of the elastic layer sections 104A at both ends in the width direction.

Next, the adhesive layer 106 will be described.

There is no particular limitation regarding the adhesive layer 106 as long as the adhesive layer 106 is capable of bonding the core 102 and the elastic layer 104 together. For example, the adhesive layer 106 is a double-sided tape or another adhesive.

A method for manufacturing the cleaning member 100 according to the present exemplary embodiment will now be described.

Figure 6A:
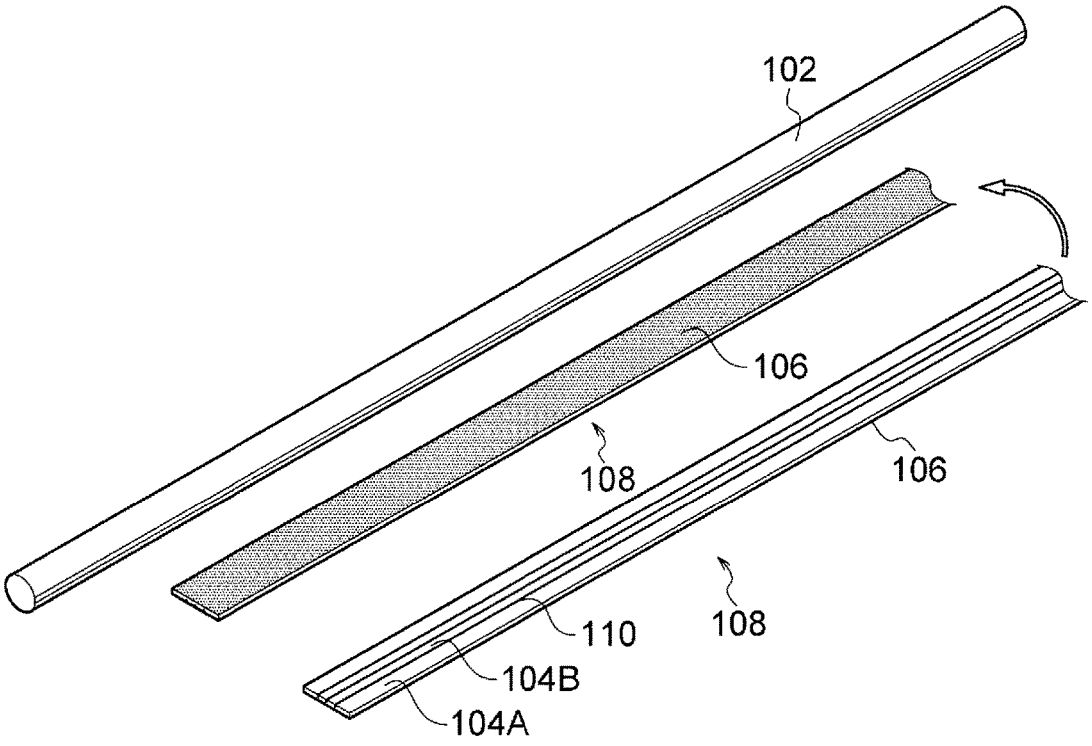
FIG. 6A illustrates a step of an example of a method for manufacturing a cleaning member according to the present exemplary embodiment.
Figure 6B:
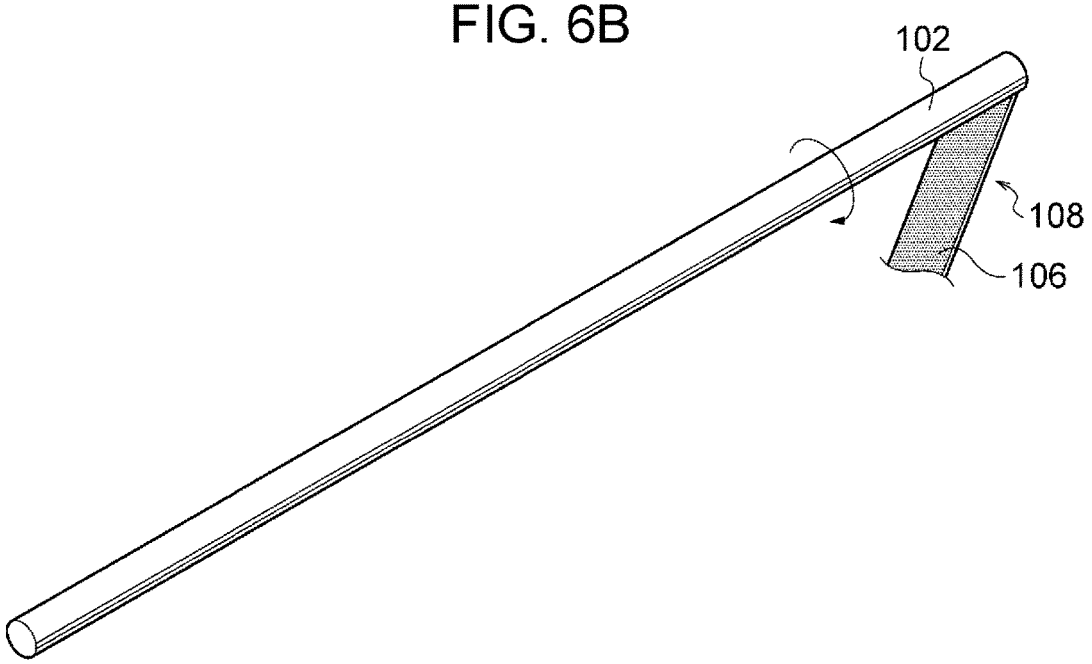
FIG. 6B illustrates another step of the method for manufacturing a cleaning member according to the present exemplary embodiment.
Figure 6C:
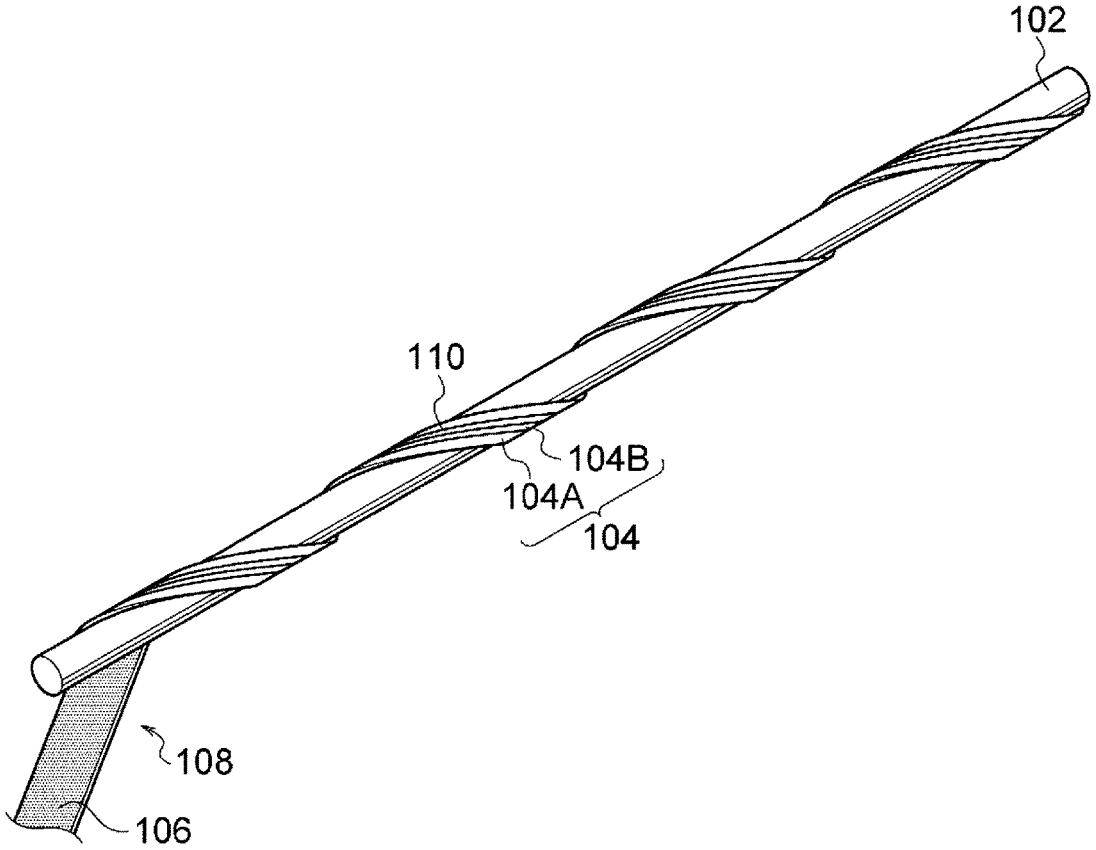
FIG. 6C illustrates another step of the method for manufacturing a cleaning member according to the present exemplary embodiment.

FIG. 6A to FIG. 6C illustrate the steps of the method for manufacturing the cleaning member 100 according to the present exemplary embodiment.

Referring to FIG. 6A, a sheet-shaped elastic member (for example, a foam polyurethane sheet) having a predetermined thickness is obtained by a slicing process. A double-sided tape that serves as the adhesive layer 106 (hereinafter also referred to simply as "double-sided tape 106") is attached to one side of the sheet-shaped elastic member. Thus, a strip 108 having predetermined width and length (strip-shaped elastic member with the double-sided tape 106 attached thereto) is obtained. The double-sided tape that serves as the adhesive layer 106 may instead be attached to one side of the sheet-shaped elastic member after the sheet-shaped elastic member is cut into elastic members having predetermined widths and lengths or after cuts are formed in the sheet-shaped elastic member.

Next, the cuts 110 are formed in the strip 108 by cutting the strip 108 at the side free from the double-sided tape (hereinafter referred to as a "front" side).

In FIG. 6A, the front side of the strip-shaped elastic member 108 is shown at the lower right, and the side of the strip-shaped elastic member 108 at which the double-sided tape is attached is shown thereabove.

The cuts 110 may be formed so as to extend at an angle (for example, at an angle in the range of ±5°) with respect to the longitudinal direction of the strip-shaped elastic member 108.

The cuts 110 may be formed so as to extend at an angle (for example, at an angle in the range of ±10°) with respect to the thickness direction of the strip-shaped elastic member 108.

Each cut 110 may be formed in the shape of a straight line, a curved line, a wavy line, or a zigzag line when viewed in the thickness direction of the strip-shaped elastic member 108 (when viewed from the front).

The cuts 110 may be formed so as not to split the strip 108 into three or more sections, or so as to split the strip 108 into three or more sections.

Next, as illustrated in FIG. 6B, the strip 108 is placed so that the side at which the double-sided tape 106 is attached faces upward. In this state, the release paper of the double-sided tape 106 is removed at one end thereof, and one end portion of the core 102 is placed on the double-sided tape from which the release paper is removed.

Next, as illustrated in FIG. 6C, the strip 108 is helically wound around the outer peripheral surface of the core 102 by rotating the core 102 at a predetermined speed while removing the release paper of the double-sided tape. Thus, the cleaning member 100 including the elastic layer 104 that is divided and helically wound around the outer peripheral surface of the core 102 is obtained.

In the present exemplary embodiment, to reduce the risk of separation of the end portions of the strip 108 in the longitudinal direction from the core 102 by reducing the restoring force of the strip 108, the strip 108 may be wound around the core 102 in such a manner that the degree of elastic deformation of the strip 108 (change in thickness in the central region in the width direction) is small. More specifically, the angle at which the strip 108 is wound and the tension applied when the strip 108 is wound may be controlled in accordance with the thickness of the strip 108.

When the strip 108 including the elastic layer 104 is wound around the core 102, the strip 108 may be positioned relative to the core 102 so that the longitudinal direction of the strip 108 is at a predetermined angle (helical angle) with respect to the axial direction of the core 102. The outer diameter of the core 102 may be, for example, in the range of from 2 mm to 12 mm.

In the case where a tension is applied to the strip 108 when the strip 108 is wound around the core 102, the tension may be set so that no gap is provided between the core 102 and the double-sided tape 106 of the strip 108. When the tension is too high, the restoring force of the strip 108 cannot be easily reduced. In addition, permanent tensile elongation increases, and the elastic force applied by the elastic layer 104 during cleaning tends to decrease. Specifically, the tension may be such that the length of the strip 108 is increased by from 0% to 5% of the original length (such that the length of the elastic layer 104 is increased to a length in the range of from 100% to 105% of the original length).

The strip 108 tends to elongate when the strip 108 is wound around the core 102. The amount of elongation differs depending on the position in the thickness direction of the strip 108, and the outermost portion tends to elongate by a large amount. The amount of elongation of the outermost portion of the strip 108 after the strip 108 is wound around the core 102 may be about 5% of the original length of the outermost portion of the strip 108. When the amount of elongation is excessively large, the elastic force applied by the elastic layer 104 may decrease.

The amount of elongation is determined by the radius of curvature at which the strip 108 is wound around the core 102 and the thickness of the strip 108. The radius of curvature at which the strip 108 is wound around the core 102 is determined by the outer diameter of the core 102 and the winding angle (helical angle θ) of the strip 108.

The radius of curvature at which the strip 108 is wound around the core 102 may be in the range of, for example, from (core outer diameter)/2+1 mm to (core outer diameter)/2+15 mm, more preferably, in the range of from (core outer diameter)/2+1.5 mm to (core outer diameter)/2+5.0 mm.

The longitudinal end portions of the strip 108 may be compressed in the thickness direction of the strip 108. When the longitudinal end portions of the strip 108 are compressed, the risk that the strip 108 will be separated from the core 102 after being bonded to the core 102 is reduced. Specifically, the longitudinal end portions of the strip 108 that is not yet bonded to the core 102 may be subjected to a compression process (thermal compression process) in which heat and pressure are applied to compress the longitudinal end portions of the strip 108 in the thickness direction of the strip 108 at a compression ratio ((thickness after compression)/(thickness before compression)×100) in the range of from 10% to 70%. As a result of the compression process, the longitudinal end portions of the strip 108 are plastically deformed into a compressed shape.

Image Forming Apparatus

An image forming apparatus according to the present exemplary embodiment will now be described with reference to the drawings.

Figure 7:
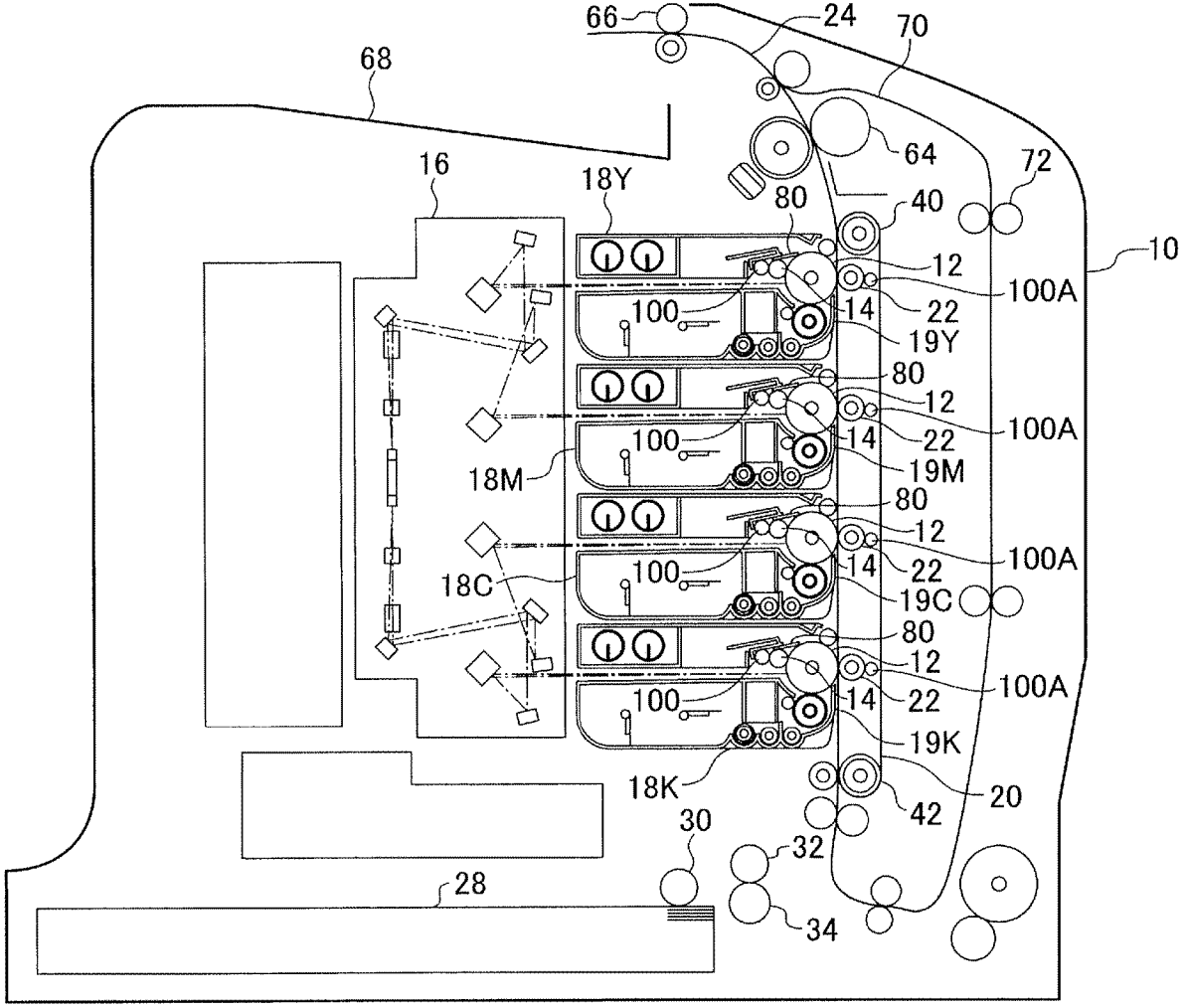
FIG. 7 is a schematic diagram illustrating an example of an image forming apparatus according to the present exemplary embodiment.
Figure 8:
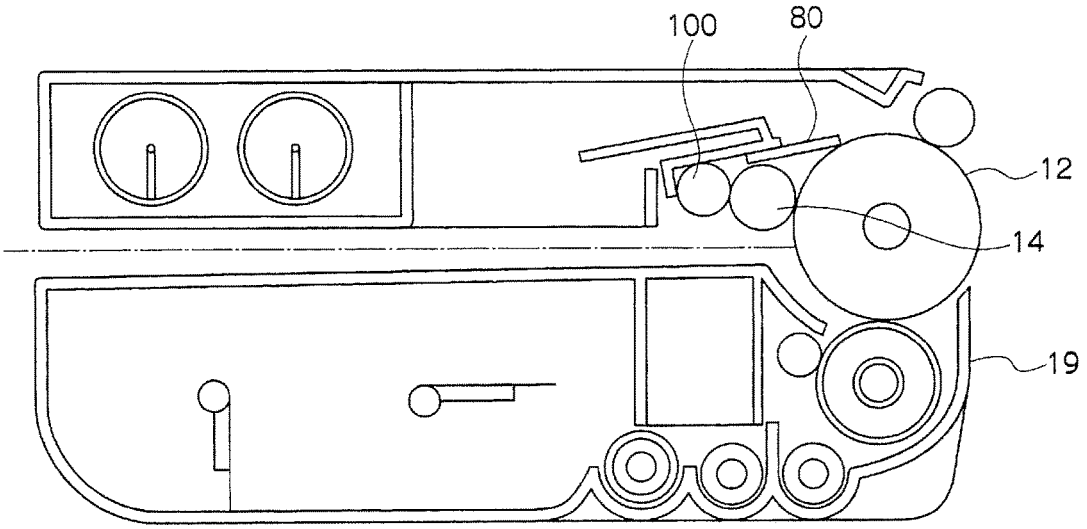
FIG. 8 is a schematic diagram illustrating an example of a process cartridge according to the present exemplary embodiment.
Figure 9:
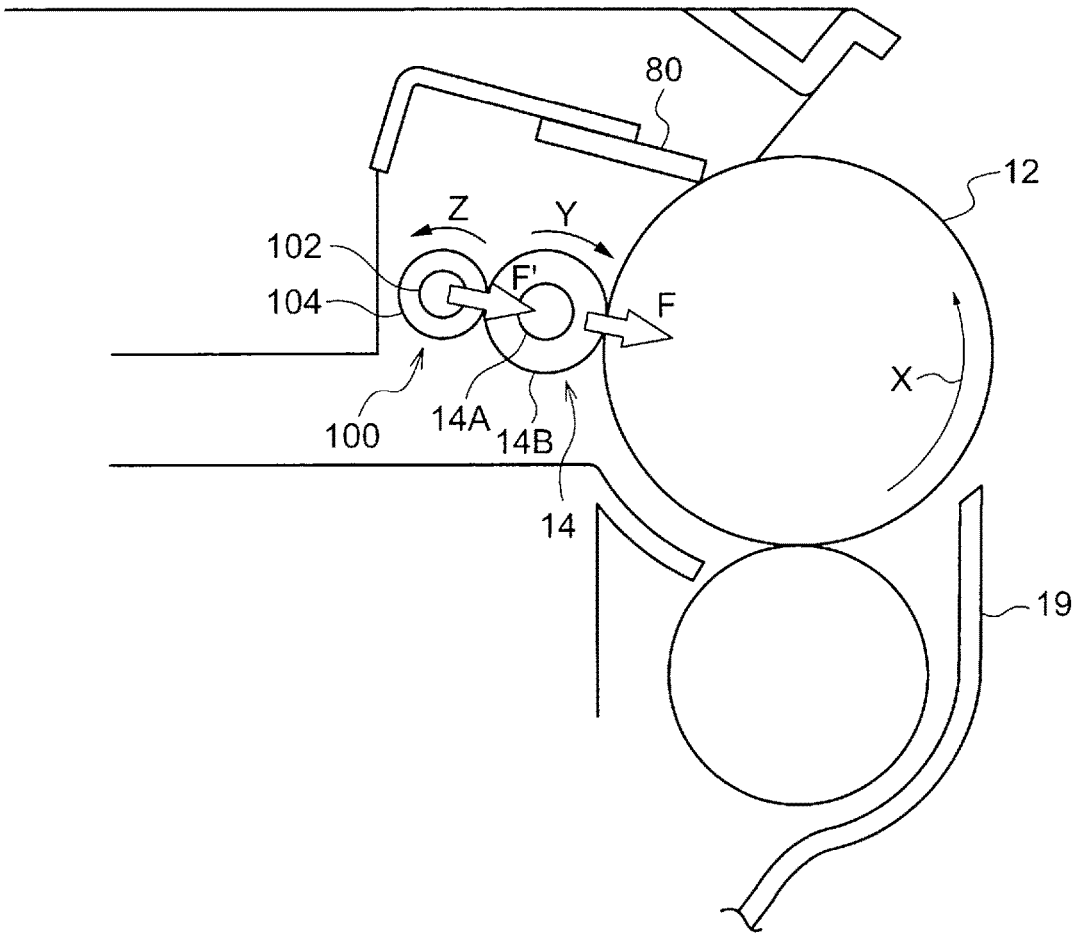
FIG. 9 is an enlarged schematic diagram illustrating the region around a charging device illustrated in FIGS. 7 and 8.

FIG. 7 is a schematic diagram illustrating an image forming apparatus according to the present exemplary embodiment. FIG. 8 is a schematic diagram illustrating a process cartridge according to the present exemplary embodiment. FIG. 9 is an enlarged schematic diagram illustrating the region around a charging device illustrated in FIGS. 7 and 8.

The image forming apparatus 10 illustrated in FIG. 7 is a tandem direct-transfer color image forming apparatus. The image forming apparatus 10 includes yellow (Y), magenta (M), cyan (C), and black (K) process cartridges 18Y, 18M, 18C, and 18K. The process cartridges 18Y, 18M, 18C, and 18K are removably attached to the image forming apparatus 10. As illustrated in FIGS. 7 and 8, each of the process cartridges 18Y, 18M, 18C, and 18K includes a photoreceptor 12, a charging member 14, and a developing device 19.

The photoreceptor 12 is, for example, a conductive cylindrical body (having a diameter of, for example, 25 mm) whose surface is covered with a photosensitive layer made of an organic photosensitive material or the like. The photoreceptor 12 is rotated at a speed of, for example, 150 mm/sec by a motor (not shown).

The surface of the photoreceptor 12 is charged by the charging member 14 disposed on the surface of the photoreceptor 12. After the photoreceptor 12 is charged, the photoreceptor 12 is exposed to a laser beam emitted from the exposure device 16 at a downstream location in the rotation direction of the photoreceptor 12. As a result, an electrostatic latent image corresponding to image information is formed.

The electrostatic latent image formed on the photoreceptor 12 is developed into a toner image by the developing device 19. When a color image is to be formed, the surface of each of the photoreceptors 12 of the respective colors is subjected to the charging, exposure, and developing processes so that toner images of the respective colors are formed on the surfaces of the photoreceptors 12.

The toner images formed on the photoreceptors 12 are transferred onto a recording sheet 24 transported by a sheet transport belt 20 at locations where the photoreceptors 12 oppose their respective transfer members 22 with the sheet transport belt 20 interposed therebetween. The sheet transport belt 20 is supported by support rollers 40 and 42 at an inner surface thereof in such a manner that a tension is applied to the sheet transport belt 20. The sheet transport belt 20 transports the recording sheet 24. The recording sheet 24 is fed from a sheet container 28 by a feed roller 30, and is transported to the sheet transport belt 20 by transport rollers 32 and 34.

The toner images of the respective colors are transferred onto the recording sheet 24 in the order of arrangement of the four process cartridges, that is, in the order of black (K), cyan (C), magenta (M), and yellow (Y) images.

The recording sheet 24 to which the toner images have been transferred is transported to a fixing device 64. The fixing device 64 fixes the toner images to the recording sheet 24 by applying heat and pressure. Then, when single-sided printing is performed, the recording sheet 24 having the toner images fixed thereto is ejected onto an ejection unit 68, which is disposed in an upper section of the image forming apparatus 10, by an ejection roller 66. When double-sided printing is performed, the ejection roller 66 is rotated in a reverse direction so that the recording sheet 24 having the toner images fixed to a first side (front side) thereof is transported to a double-sided-printing sheet transport path 70. Then, transport rollers 72 provided on the sheet transport path 70 transports the recording sheet 24 to the sheet transport belt 20 again in a reversed state, and toner images are transferred onto a second side (rear side) of the recording sheet 24 from the photoreceptors 12. The recording sheet 24 to which the toner images have been transferred at the second side (rear side) thereof is transported to the fixing device 64, and the fixing device 64 fixes the toner images to the recording sheet 24. Then, the recording sheet 24 having the toner images fixed to both sides thereof is ejected onto the ejection unit 68 by the ejection roller 66.

After the toner images have been transferred, residual toner, paper dust, etc., on the surface of each photoreceptor 12 are removed by a cleaning blade 80, which is disposed downstream of the position where the transferring is performed in the rotation direction of the photoreceptor 12, each time the photoreceptor 12 rotates one revolution. Thus, each photoreceptor 12 prepares for the next image forming operation.

Each transfer member 22 is, for example, a roller including a conductive core and a conductive elastic layer provided on the outer peripheral surface of the conductive core. The conductive core is rotatably supported in the image forming apparatus 10. A cleaning member 100A for cleaning the transfer member 22 is in contact with the transfer member 22 at a side opposite to the photoreceptor 12. The transfer member 22 and the cleaning member 100A form a transfer device (unit) (see FIG. 7). The cleaning member 100 illustrated in FIG. 1 (cleaning member according to the present exemplary embodiment), for example, may be used as the cleaning member 100A. The cleaning member 100A may be a member that is constantly in contact with the transfer member 22 and rotated by the transfer member 22; a member that is in contact with the transfer member 22 only during a cleaning process and rotated by the transfer member 22; or a member that is in contact with the transfer member 22 only during the cleaning process and rotated by another drive source.

As illustrated in FIG. 9, for example, the charging member 14 is a roller including a conductive core 14A and an elastic foam layer 14B provided on the outer peripheral surface of the conductive core 14A. The conductive core 14A is rotatably supported in the developing device 19. A cleaning member 100 for cleaning the charging member 14 is in contact with the charging member 14 at a side opposite to the photoreceptor 12. The charging member 14 and the cleaning member 100 form a charging device (unit) (see FIGS. 8 and 9). The cleaning member according to the present exemplary embodiment is used as the cleaning member 100. The cleaning member 100 may be a member that is constantly in contact with the charging member 14 and rotated by the charging member 14; a member that is in contact with the charging member 14 only during a cleaning process and rotated by the charging member 14; or a member that is in contact with the charging member 14 only during the cleaning process and rotated by another drive source.

As illustrated in FIG. 9, for example, a load F is applied to the conductive core 14A of the charging member 14 at both ends thereof so that the charging member 14 is pressed against the photoreceptor 12. Accordingly, the foam elastic layer 14B is elastically deformed and a nip portion is formed along the outer peripheral surface of the photoreceptor 12.

As illustrated in FIG. 9, for example, a load F' is applied to the core 102 of the cleaning member 100 at both ends thereof so that the cleaning member 100 is pressed against the charging member 14. Accordingly, the elastic layer 104 is elastically deformed and a nip portion is formed along the outer peripheral surface of the charging member 14.

In the structure illustrated in FIG. 9, the photoreceptor 12 is rotated in the direction of arrow X by a motor (not shown), and the charging member 14 is rotated in the direction of arrow Y by the rotation of the photoreceptor 12. Also, the cleaning member 100 is rotated in the direction of arrow Z by the rotation of the charging member 14.

Although examples of the image forming apparatus and process cartridge according to the present exemplary embodiment are described above with reference to FIGS. 7 to 9, the present exemplary embodiment is not limited by the foregoing description.

The image forming apparatus according to the present exemplary embodiment is not limited to a tandem direct-transfer image forming apparatus as illustrated in FIG. 7, and may instead include another common transfer system such as an intermediate transfer system. In addition, the image forming apparatus according to the present exemplary embodiment may include devices and components that are not assembled into cartridges but are arranged independently.

The process cartridge including a charging device according to the present exemplary embodiment may include at least one of a photoreceptor, an exposure device, a developing device, and a transfer device in addition to the charging device (unit of the charging member and the cleaning member).

The process cartridge including a transfer device according to the present exemplary embodiment may include at least one of a photoreceptor, an exposure device, a charging device, and a developing device in addition to the transfer device (unit of the transfer member and the cleaning member).

The object whose surface is to be cleaned by the cleaning member according to the present exemplary embodiment is not limited to a charging member or a transfer member. The object to be cleaned may instead be, for example, a photoreceptor, a sheet transport belt, a second transfer member (for example, a second transfer roller) of an intermediate transfer system, or an intermediate transfer body (for example, an intermediate transfer belt) of an intermediate transfer system. The object to be cleaned and the cleaning member that contacts the object may be unitized as a process cartridge that is detachably attachable to the image forming apparatus.

A charging member will be described as an example of an object whose surface is to be cleaned by the cleaning member according to the present exemplary embodiment.

The charging member includes, for example, a core and an elastic layer. The elastic layer may have a single-layer structure or a multilayer structure obtained by stacking plural layers together. The outer surface of the elastic layer may be surface treated. Alternatively, a surface layer containing a polymeric material may be stacked on the outer peripheral surface of the elastic layer.

The core may be made of, for example, free-cutting steel or stainless steel, and the surface thereof may be plated. When the material of the core is not conductive, the core may be subjected to a conductivity imparting process, such as plating.

The elastic layer is a conductive elastic layer. The conductive elastic layer contains an elastic material, such as rubber, and a conductive agent, such as a carbon black or an ion conductive agent. For example, the conductive agent is dispersed in the elastic material. The elastic layer may further contain, for example, a softening agent, a plasticizer, a curing agent, a vulcanizing agent, a vulcanization accelerator, an antioxidant, a slip additive, and a filler (for example, silica or calcium carbonate). The conductive elastic layer is formed by covering an outer peripheral surface of the conductive core with a mixture of the above-mentioned materials. The elastic material may be a foam. In this case, the conductive elastic layer is a conductive foam elastic layer.

Examples of the elastic material contained in the conductive elastic layer include silicone rubbers, ethylene propylene rubbers, epichlorohydrin rubbers, epichlorohydrin-ethylene oxide copolymer rubbers, epichlorohydrin-ethylene oxide-allyl glycidyl ether copolymer rubbers, acrylonitrile-butadiene copolymer rubbers, and mixtures thereof. These elastic materials may be used individually or in combination with each other.

The conductive agent may be an electronic conductive agent or an ion conductive agent. Examples of the electronic conductive agent include particles of carbon blacks, such as Ketjen black and acetylene black; pyrolytic carbons and graphites; conductive metals and alloys such as aluminum, copper, nickel, and stainless steel; conductive metal oxides such as tin oxide, indium oxide, titanium oxide, tin oxide-antimony oxide solid solution, and tin oxide-indium oxide solid solution; and insulating materials having surfaces subjected to a conductivity imparting process. Examples of the ion conductive agent include perchlorates and chlorates of oniums such as tetraethylammonium and lauryltrimethylammonium; and perchlorates and chlorates of alkali metals and alkaline earth metals such as lithium and magnesium.

These conductive agents may be used individually or in combination with each other. The amount of the conductive agent is not particularly limited. When the conductive agent is an electronic conductive agent, the amount thereof may be in the range of from 1 to 60 parts by weight for 100 parts by weight of elastic material. When the conductive agent is an ion conductive agent, the amount thereof may be in the range of from 0.1 to 5.0 parts by weight for 100 parts by weight of elastic material.

A surface layer containing a polymeric material may be provided on the surface of the charging member. Examples of the polymeric material contained in the surface layer include polyvinylidene fluoride, ethylene tetrafluoride copolymers, polyesters, polyimides, and copolymer nylons. Copolymer nylons are copolymers including one or more of nylon 610, nylon 11, and nylon 12 as a polymerization unit, and may also include nylon 6 and nylon 66 as another polymerization unit. The total content of nylon 610, nylon 11, and nylon 12 in the copolymer nylon may be 10% by weight or more.

The number-average molecular weight of the polymeric material may be in the range of from 1,000 to 100,000, and more preferably, in the range of from 10,000 to 50,000. The above-mentioned polymeric materials may be used individually or in combination with each other. A fluorine-based or silicone-based resin may be used as the polymeric material contained in the surface layer.

The resistance of the surface layer may be adjusted by adding a conductive material. The conductive material may be in the form of powder having a particle size of 3 μm or less. Examples of the conductive material used to adjust the resistance include carbon blacks, conductive metal oxide particles, and ion conductive agents. These conductive materials may be used individually or in combination with each other.

Examples of carbon blacks include "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V", all of which are produced by Orion Engineered Carbons LLC, and "MONARCH 1000", "MONARCH 1300", "MONARCH 1400", "MOGUL-L", and "REGAL 400R", all of which are produced by Cabot Corporation. The carbon black may have a pH of 4.0 or less.

Examples of conductive metal oxide particles include particles of conductive agents having electrons as charge carriers, such as tin oxide, antimony-doped tin oxide, zinc oxide, anatase titanium oxide, and indium tin oxide (ITO).

The surface layer may contain insulating particles, such as alumina or silica particles. When the charging member has an irregular surface formed of these particles, the charging member more easily slides along the photoreceptor, and the wear resistances of the charging member and the photoreceptor increase.

The outer diameter of the charging member may be in the range of from 8 mm to 16 mm. The microhardness of the charging member may be in the range of from 45° to 60°.

EXAMPLES

Exemplary embodiments of the present invention will now be described in detail by way of examples. However, the exemplary embodiments of the present invention are not limited to the examples described below in any way.

Example 1: Preparation of Cleaning Roller 1

A sheet of urethane foam (EP-70 produced by Inoac Corporation) having a thickness of 2.4 mm is cut to obtain a strip having a width of 13 mm and a length of 360 mm. A double-sided tape (No. 5605 produced by Nitto Denko Corporation) having a thickness of 0.05 mm is attached to the strip over the entire surface thereof. Thus, a strip having a double-sided tape attached thereto is obtained.

The strip having the double-sided tape is placed on a table so that the urethane foam sheet faces upward. Next, the strip having the double-sided tape is cut with a single bevel knife from one longitudinal end to the other longitudinal end so that the cutting depth is 90% of the thickness of the elastic layer in a direction perpendicular to the surface of the strip having the double-sided tape. Thus, a strip having a double-sided tape in which a urethane foam sheet is divided into three sections extending in the axial direction (5-mm-wide section at one end, 3-mm-wide section at the center, and 5-mm-wide section at the other end) is obtained.

The thus-obtained strip having the double-sided tape is placed on a horizontal table so that the release paper attached to the double-sided tape faces downward. Then, longitudinal end portions of the strip are pressed from above with a heated stainless steel device so that the thickness of the strip in regions within 1 mm from the longitudinal ends of the strip is reduced to 15% of the thickness of the strip in the remaining region.

The thus-obtained strip having the double-sided tape is placed on the horizontal table so that the release paper attached to the double-sided tape faces upward, and is wound around a metal core (material: SUM24EZ, outer diameter: 5.0 mm, overall length: 338 mm) at a helical angle θ of 25° while tension is applied thereto so that the overall length of the strip increases in the range of from 0% to 5%.

As a result of the above-described processes, a cleaning roller 1 including a core and an elastic layer that is divided into three elastic layer sections and helically wound around an outer peripheral surface of the core is obtained. The elastic layer is divided into three elastic layer sections so that the ratio ($W_3/W_4/W_3$) between the widths ($W_3$) of the elastic layer sections at both ends in the width direction and the width ($W_4$) of the elastic layer section in the central region between the elastic layer sections at both ends in the width direction is 5 mm/3 mm/5 mm.

Table 1 shows the minimum thickness ($D_1$) of the elastic layer sections at both ends in the width direction, the minimum thickness ($D_2$) of the elastic layer section in the central region between the elastic layer sections at both ends in the width direction, the height ($\Delta D_{41}$) of the projecting portions of the elastic layer sections at both ends in the width direction, and the height ($\Delta D_{42}$) of the projecting portions of the elastic layer section in the central region.

Examples 2 to 4, 6, and 7: Preparation of Cleaning Rollers 2 to 4, 6, and 7

Cleaning rollers 2 to 4, 6, and 7 are produced by processes similar to those in Example 1 except that the number of sections into which the elastic layer is divided, the width ($W_3$) of the elastic layer sections at both ends in the width direction, the width ($W_4$) of the elastic layer section or sections in the central region between the elastic layer sections at both ends in the width direction, the minimum thickness ($D_1$) of the elastic layer sections at both ends in the width direction, the minimum thickness ($D_2$) of the elastic layer section or sections in the central region between the elastic layer sections at both ends in the width direction, the height ($\Delta D_{41}$) of the projecting portions of the elastic layer sections at both ends in the width direction, and the height ($\Delta D_{42}$) of the projecting portions of the elastic layer section or sections in the central region are set as shown in Table 1. For the examples in which the elastic layer is divided into four sections, the sum ($\Sigma W_4$) of the widths ($W_4$) of the elastic layer sections in the central region is also determined. Table 1 shows the values of each of the above-mentioned parameters.

Example 5: Preparation of Cleaning Roller 5

A sheet of urethane foam (EP-70 produced by Inoac Corporation) having a thickness of 2.4 mm is cut to obtain two strips having a width of 5 mm and a length of 360 mm and a strip having a width of 3 mm and a length of 360 mm. A double-sided tape (No. 5605 produced by Nitto Denko Corporation) having a thickness of 0.05 mm is attached to each of the three strips over the entire surface thereof. Thus, strips having a double-sided tape attached thereto are obtained.

Cleaning roller 5 is produced by processes similar to those in Example 1 except that the strips having the double-sided tapes are wound around the core so that the 5-mm-wide strips having the double-sided tapes are at both ends and the 3-mm-wide strip having the double-sided tape is at the center in the width direction and so that the longitudinal edges of the strips having the double-sided tapes are in contact with each other.

Table 1 shows the minimum thickness ($D_1$) of the elastic layer sections at both ends in the width direction, the minimum thickness ($D_2$) of the elastic layer section in the central region between the elastic layer sections at both ends in the width direction, the height ($\Delta D_{41}$) of the projecting portions of the elastic layer sections at both ends in the width direction, and the height ($\Delta D_{42}$) of the projecting portions of the elastic layer section in the central region.

Comparative Examples 1 to 4: Preparation of Comparative Cleaning Rollers C1 to C4

Comparative cleaning rollers C1 to C4 are produced by processes similar to those in Example 1 except that the number of sections into which the elastic layer is divided, the width ($W_3$) of the elastic layer sections at both ends in the width direction, the width ($W_4$) of the elastic layer section or sections in the central region between the elastic layer sections at both ends in the width direction, the minimum thickness ($D_1$) of the elastic layer sections at both ends in the width direction, the minimum thickness ($D_2$) of the elastic layer section or sections in the central region between the elastic layer sections at both ends in the width direction, the height ($\Delta D_{41}$) of the projecting portions of the elastic layer sections at both ends in the width direction, and the height ($\Delta D_{42}$) of the projecting portions of the elastic layer section or sections in the central region are set as shown in Table 1. Table 1 shows the values of each of the above-mentioned parameters.

Comparative Example 5: Preparation of Comparative Cleaning Roller C5

A sheet of urethane foam (EP-70 produced by Inoac Corporation) having a thickness of 2.4 mm is cut to obtain two strips having a width of 5 mm and a length of 360 mm and a strip having a width of 3 mm and a length of 360 mm. A double-sided tape (No. 5605 produced by Nitto Denko Corporation) having a thickness of 0.05 mm is attached to each strip over the entire surface thereof. Thus, strips having a double-sided tape attached thereto are obtained.

Comparative cleaning roller C5 is produced by processes similar to those in Example 1 except that the strips having the double-sided tapes are wound around the core so that the 5-mm-wide strips having the double-sided tapes are at both ends and the 3-mm-wide strip having the double-sided tape is at the center in the width direction and so that the strips having the double-sided tapes are spaced from each other.

Table 1 shows the minimum thickness ($D_1$) of the elastic layer sections at both ends in the width direction, the minimum thickness ($D_2$) of the elastic layer section in the central region between the elastic layer sections at both ends in the width direction, the height ($\Delta D_{41}$) of the projecting portions of the elastic layer sections at both ends in the width direction, and the height ($\Delta D_{42}$) of the projecting portions of the elastic layer section in the central region.

Evaluations

The prepared cleaning rollers of the examples and comparative examples are evaluated as described below. For the evaluations, the following charging roller is prepared as an object to be cleaned.

Preparation of Charging Roller

Formation of Elastic Layer

A mixture of components listed below is kneaded with an open roll, and is applied to an outer peripheral surface of a conductive core, which is made of SUS416 and has a diameter of 9 mm, to a thickness of 1.5 mm. The core coated with the mixture is placed in a cylindrical die having an inner diameter of 12.0 mm, subjected to a vulcanization process for 30 minutes at 170° C., taken out of the die, and subjected to polishing. Thus, a cylindrical conductive elastic layer is obtained.

- 100 parts by weight of rubber material (epichlorohydrin-ethylene oxide-allyl glycidyl ether copolymer rubber, GECHRON3106, produced by Zeon Corporation)
- 25 parts by weight of conductive agent (carbon black, Asahi Thermal, produced by Asahi Carbon Co., Ltd.)
- 8 parts by weight of conductive agent (Ketjen Black EC, produced by Lion Corporation)
- 1 part by weight of ion conductive agent (lithium perchlorate)
- 1 part by weight of vulcanizing agent (sulfur, 200 mesh, produced by Tsurumi Chemical Industry Co., Ltd.)
- 2.0 parts by weight of vulcanization accelerator (Nocceler DM, produced by Ouchi Shinko Chemical Industrial Co., Ltd.)
- 0.5 parts by weight of vulcanization accelerator (Nocceler TT, produced by Ouchi Shinko Chemical Industrial Co., Ltd.)

Formation of Surface Layer

Dispersion liquid obtained by dispersing a mixture of components listed below with a bead mill is diluted with methanol, applied to a surface (outer peripheral surface) of the conductive elastic layer by dip-coating, and thermally dried at 140° C. for 15 minutes. Thus, a charging roller including a surface layer having a thickness of 4 μm is obtained.

- 100 parts by weight of polymeric material (copolymer nylon, Amilan CM8000, produced by Toray Industries, Inc.)
- 30 parts by weight of conductive agent (antimony-doped tin oxide, SN-100P, produced by Ishihara Sangyo Kaisha, Ltd.)
- 500 parts by weight of solvent (methanol)
- 240 parts by weight of solvent (butanol)

Evaluation

Each of the cleaning rollers of the examples and comparative examples prepared as described above is evaluated for permanent compressive strain and cleaning performance. Table 1 shows the evaluation results. The permanent compressive strain and cleaning performance are evaluated as follows.

Evaluation of Permanent Compressive Strain

The permanent compressive strain is evaluated by using each of the cleaning rollers of the examples and comparative examples prepared as described above and the charging roller. Fixing devices are attached to end portions of each cleaning roller and the charging roller so that the rollers are secured in a contact state. The fixing devices are configured to set the distance between the axes of the rollers to 10 mm (ϕ9 and ϕ5 core attachment holes are formed in resin pieces made of POM having a size of 30 mm×20 mm so that the center distance therebetween is 10 mm).

In the evaluation test, the rollers are stored in an environment of 45° C. and 90% RH for seven days, and then taken out. The roller layer thickness of each cleaning roller is measured with a laser displacement meter by the above-described method before and after the cleaning roller is stored, and a change in the roller layer thickness is determined as an amount of permanent strain.

Evaluation of Permanent Compressive Strain: Evaluation Criteria

G0: Difference between the roller layer thickness of the cleaning roller before storage and that after storage is less than or equal to 0.05 mm.

G0.5: Difference between the roller layer thickness of the cleaning roller before storage and that after storage is greater than 0.05 mm and less than or equal to 0.1 mm.

G1: Difference between the roller layer thickness of the cleaning roller before storage and that after storage is greater than 0.1 mm and less than or equal to 0.15 mm.

G2: Difference between the roller layer thickness of the cleaning roller before storage and that after storage is greater than 0.15 mm.

Evaluation of Cleaning Performance

Evaluation of Cleaning Performance 1

A cleaning performance evaluation test is performed by attaching each of the cleaning rollers of the examples and comparative examples prepared as described above to a drum cartridge of a color multifunction machine DocuCentre-V C7775, produced by Fuji Xerox Co., Ltd., together with the charging roller.

In the evaluation test, a strip-shaped image pattern having a length of 320 mm in the output direction and a width of 30 mm is printed on 75,000 A3 recording sheets at an image density of 100% in an environment of 10° C. and 15% RH. Then, the surface of a portion of the charging roller 14 used to print the image pattern is observed to evaluate the performance in removing deposits as the cleaning performance. The surface of the charging roller is directly observed by using a confocal laser microscope (OLS1100, produced by Olympus Corporation). The cleaning performance is evaluated based on the following criteria.

Evaluation of Cleaning Performance 1: Evaluation Criteria

G0: Deposits are present in an area of less than or equal to 10% per 1 μm square area of the surface of the charging roller.

G0.5: Deposits are present in an area of more than 10% and less than or equal to 20% per 1 μm square area of the surface of the charging roller.

G1: Deposits are present in an area of more than 20% and less than or equal to 30% per 1 μm square area of the surface of the charging roller.

G2: Deposits are present in an area of more than 30% and less than or equal to 50% per 1 μm square area of the surface of the charging roller.

G3: Deposits are present in an area of more than 50% per 1 μm square area of the surface of the charging roller.

Evaluation of Cleaning Performance 2

A cleaning performance evaluation test is performed by attaching each of the cleaning rollers of the examples and comparative examples that have been stored for the above-described evaluation of permanent strain to a drum cartridge of a color multifunction machine DocuCentre-V C7775, produced by Fuji Xerox Co., Ltd., together with the charging roller.

In the evaluation test, a strip-shaped image pattern having a length of 320 mm in the output direction and a width of 30 mm is printed on 150,000 A3 recording sheets at an image density of 100% in an environment of 10° C. and 15% RH. Then, the surface of a portion of the charging roller used to print the image pattern is observed to evaluate the performance in removing deposits as the cleaning performance. The surface of the charging roller is directly observed by using a confocal laser microscope (OLS1100, produced by Olympus Corporation). In the evaluation of cleaning performance 2, the cleaning performance is evaluated based on the same criteria as the criteria used in the evaluation of cleaning performance 1.

TABLE 1

| | | | | Example 1 | Example 2 | Example 3 | Example 4 | Example 5 | Example 6 | Example 7 |
|---|---|---|---|---|---|---|---|---|---|---|
| | Cleaning Roller No. | | | 1 | 2 | 3 | 4 | 5 | 6 | 7 |
| Elastic Layer | Dividing Number (Number of Sections) | | | 3 | 3 | 4 | 4 | 3 | 3 | 3 |
| | Dividing Method | | | Cut | Cut | Cut | Cut | Contact | Cut | Cut |
| | End | Width | $W_3$ (mm) | 5 | 5 | 5 | 5 | 5 | 6 | 4 |
| | | Minimum Thickness | $D_1$ (mm) | 2.20 | 2.20 | 2.20 | 2.20 | 2.20 | 2.10 | 2.25 |
| | | Projecting Portion Height | $\Delta D_{41}$ (mm) | 0.22 | 0.22 | 0.22 | 0.22 | 0.22 | 0.27 | 0.17 |
| | Center | Width | $W_4$ (mm) | 3 | 4 | 3 | 2 | 3 | 3 | 2 |
| | | Minimum Thickness | $D_2$ (mm) | 2.33 | 2.25 | 2.33 | 2.38 | 2.33 | 2.33 | 2.38 |
| | | Projecting Portion Height | $\Delta D_{42}$ (mm) | 0.14 | 0.17 | 0.14 | 0.12 | 0.14 | 0.14 | 0.12 |
| | | Width | $W_4$ (mm) | — | — | 3 | 2 | — | — | — |
| | | Minimum Thickness | $D_2$ (mm) | — | — | 2.33 | 2.38 | — | — | — |
| | | Projecting Portion Height | $\Delta D_{42}$ (mm) | — | — | 0.14 | 0.12 | — | — | — |
| | | Sum of $W_4$ | $\Sigma W_4$ (mm) | — | — | 6 | 4 | — | — | — |
| | End | Width | $W_3$ (mm) | 5 | 5 | 5 | 5 | 5 | 6 | 4 |
| | | Minimum Thickness | $D_1$ (mm) | 2.20 | 2.20 | 2.20 | 2.20 | 2.20 | 2.10 | 2.25 |
| | | Projecting Portion Height | $\Delta D_{41}$ (mm) | 0.22 | 0.22 | 0.22 | 0.22 | 0.22 | 0.27 | 0.17 |
| Evaluation Result | Permanent Compressive Strain | | | G0 | G0.5 | G0 | G0 | G0 | G0 | G0 |
| | Cleaning Performance 1 | | | G0.5 | G0.5 | G0 | G0 | G0.5 | G0.5 | G0.5 |
| | Cleaning Performance 2 | | | G0.5 | G0.5 | G0 | G0 | G0.5 | G0.5 | G0.5 |

| | | | | Comparative Example 1 | Comparative Example 2 | Comparative Example 3 | Comparative Example 4 | Comparative Example 5 |
|---|---|---|---|---|---|---|---|---|
| | Cleaning Roller No. | | | C1 | C2 | C3 | C4 | C5 |
| Elastic Layer | Dividing Number (Number of Sections) | | | 2 | 3 | 3 | 3 | 3 |
| | Dividing Method | | | Cut | Cut | Cut | Cut | Separate |
| | End | Width | $W_3$ (mm) | 5 | 5 | 5 | 5 | 5 |
| | | Minimum Thickness | $D_1$ (mm) | 2.20 | 2.20 | 2.20 | 2.20 | 2.20 |
| | | Projecting Portion Height | $\Delta D_{41}$ (mm) | 0.22 | 0.22 | 0.22 | 0.22 | 0.22 |
| | Center | Width | $W_4$ (mm) | — | 5 | 5 | 6 | 3 |
| | | Minimum Thickness | $D_2$ (mm) | — | 2.20 | 2.20 | 2.10 | 2.33 |
| | | Projecting Portion Height | $\Delta D_{42}$ (mm) | — | 0.22 | 0.22 | 0.27 | 0.14 |
| | | Width | $W_4$ (mm) | — | — | — | — | — |
| | | Minimum Thickness | $D_2$ (mm) | — | — | — | — | — |
| | | Projecting Portion Height | $\Delta D_{42}$ (mm) | — | — | — | — | — |
| | | Sum of $W_4$ | $\Sigma W_4$ (mm) | — | — | — | — | — |
| | End | Width | $W_3$ (mm) | 5 | 5 | 3 | 5 | 5 |
| | | Minimum Thickness | $D_1$ (mm) | 2.20 | 2.20 | 2.33 | 2.20 | 2.20 |
| | | Projecting Portion Height | $\Delta D_{41}$ (mm) | 0.22 | 0.22 | 0.14 | 0.22 | 0.22 |
| Evaluation Result | Permanent Compressive Strain | | | G2 | G2 | G1 | G2 | G1 |
| | Cleaning Performance 1 | | | G2 | G0.5 | G1 | G0.5 | G0.5 |
| | Cleaning Performance 2 | | | G3 | G1 | G2 | G2 | G1 |

In the "Diving Method" row in Table 1, "Cut" means that the elastic layer divided into sections is obtained by forming cuts in the elastic layer, "Contact" means that the elastic layer divided into sections is obtained by bringing longitudinal edges of separate strips into contact with each other, and "Separate" means that the elastic layer includes strips that are wound around the core with gaps therebetween.

In the rows of "Elastic Layer", the projecting portion height "$\Delta D_{41}$" is the difference between the edge thickness ($D_4$) and the minimum thickness ($D_1$) of the elastic layer sections at both ends. Also, the projecting portion height "$\Delta D_{42}$" is the difference between the edge thickness ($D_4$) and the minimum thickness ($D_2$) of the elastic layer section or sections in the central region between the elastic layer sections at both ends.

The results show that the cleaning performances of the cleaning rollers according to the examples are higher than those of the cleaning rollers according to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a core; and an elastic layer comprising a strip-shaped elastic member that is helically wound around an outer peripheral surface of the core from one end to another end of the core, wherein the strip-shaped elastic member is divided into three or more elastic member sections in a width direction of the strip-shaped elastic member, wherein the elastic member sections are integrated together with a cut provided therebetween, and wherein a width of the elastic member sections at both ends in the width direction is greater than a width of the one or more elastic member sections in a central region between the elastic member sections at both ends in the width direction, or a minimum thickness of the elastic member sections at both ends in the width direction is smaller than a minimum thickness of the one or more elastic member sections in the central region between the elastic member sections at both ends in the width direction.

2. The cleaning member according to claim 1, wherein the width of the elastic member sections at both ends in the width direction is greater than the width of the one or more elastic member sections in the central region between the elastic member sections at both ends in the width direction.

3. The cleaning member according to claim 2, wherein the strip-shaped elastic member is divided into three elastic member sections in the width direction.

4. The cleaning member according to claim 2, wherein the elastic member is divided into four or more elastic member sections in the width direction.

5. The cleaning member according to claim 4, wherein the width of the elastic member sections at both ends in the width direction is smaller than a sum of widths of the elastic member sections in the central region between the elastic member sections at both ends in the width direction.

6. The cleaning member according to claim 2, wherein a ratio (W3/W4) of the width W3 of the elastic member sections at both ends in the width direction to the width W4 of the one or more elastic member sections in the central region between the elastic member sections at both ends in the width direction is in a range of from about 1.2 to about 3.0.

7. The cleaning member according to claim 4, wherein a ratio (W3/sum of W4) of the width W3 of the elastic member sections at both ends in the width direction to a sum of widths W4 of the elastic member sections in the central region between the elastic member sections at both ends in the width direction is equal to or greater than about 0.3.

8. The cleaning member according to claim 2, wherein the width W3 of the elastic member sections at both ends in the width direction is in a range of from about 3 mm to about 6 mm.

9. The cleaning member according to claim 2, wherein the width W4 of the one or more elastic member sections in the central region between the elastic member sections at both ends in the width direction is in a range of from about 2 mm to about 5 mm.

10. The cleaning member according to claim 1, wherein the minimum thickness of the elastic member sections at both ends in the width direction is smaller than the minimum thickness of the one or more elastic member sections in the central region between the elastic member sections at both ends in the width direction.

11. The cleaning member according to claim 10, wherein the strip-shaped elastic member is divided into three elastic member sections in the width direction.

12. The cleaning member according to claim 10, wherein the strip-shaped elastic member is divided into four or more elastic member sections in the width direction.

13. The cleaning member according to claim 10, wherein a ratio (D1/D2) of the minimum thickness D1 of the elastic member sections at both ends in the width direction to the minimum thickness D2 of the one or more elastic member sections in the central region between the elastic member sections at both ends in the width direction is in a range of from about 0.85 to about 0.98.

14. The cleaning member according to claim 10, wherein the minimum thickness D1 of the elastic member sections at both ends in the width direction is in a range of from about 1.5 mm to about 3 mm.

15. The cleaning member according to claim 10, wherein the minimum thickness D2 of the one or more elastic member sections in the central region between the elastic member sections at both ends in the width direction is in a range of from about 1.7 mm to about 3.2 mm.

16. The cleaning member according to claim 10, wherein an edge thickness D4 and the minimum thickness D1 of the elastic member sections at both ends in the width direction have a difference ΔD41 (=D4−D1) in a range of from about 0.1 mm to about 0.3 mm.

17. The cleaning member according to claim 10, wherein an edge thickness D4 and the minimum thickness D2 of the one or more elastic member sections in the central region between the elastic member sections at both ends in the width direction have a difference ΔD42 (=D4−D2) in a range of from about 0.05 mm to about 0.25 mm.

18. A process cartridge comprising:

a charging device including a charging member that charges an object to be charged, and the cleaning member according to claim 1 that contacts a surface of the charging member and cleans the surface of the charging member, wherein the process cartridge is removably attachable to an image forming apparatus.

19. An image forming apparatus comprising:

an electrophotographic photoreceptor;

a charging device including a charging member that charges the electrophotographic photoreceptor, and the cleaning member according to claim 1 that contacts a surface of the charging member and cleans the surface of the charging member;

an electrostatic-latent-image forming device that forms an electrostatic latent image on a surface of the electrophotographic photoreceptor that is charged;

a developing device that forms a toner image by developing the electrostatic latent image, formed on the surface of the electrophotographic photoreceptor, by using developer containing toner; and a transfer device that transfers the toner image onto a surface of a recording medium.

20. The cleaning member according to claim 3, wherein each of the three elastic member sections comprise a projecting portion that projects in the radially outward direction of the core.

* * * * *